US008087728B2

(12) United States Patent
Corcoran

(10) Patent No.: US 8,087,728 B2
(45) Date of Patent: Jan. 3, 2012

(54) RAISER SEAT

(75) Inventor: Steven Phillip Corcoran, N. Yorkshire (GB)

(73) Assignee: Corcost Limited (GB)

( * ) Notice: Subject to any disclaimer, the term of this patent is extended or adjusted under 35 U.S.C. 154(b) by 0 days.

(21) Appl. No.: 12/565,277

(22) Filed: Sep. 23, 2009

(65) Prior Publication Data

US 2010/0242168 A1 Sep. 30, 2010

Related U.S. Application Data

(63) Continuation of application No. 10/568,599, filed as application No. PCT/GB2004/003531 on Aug. 17, 2004, now Pat. No. 7,600,815.

(30) Foreign Application Priority Data

Aug. 13, 2003 (GB) ..... 0319526.0
Aug. 13, 2003 (GB) ..... 0319533.6
Aug. 13, 2003 (GB) ..... 0319538.5

(51) Int. Cl.
*A47C 1/00* (2006.01)

(52) U.S. Cl. ..... 297/344.14; 297/339; 297/313; 297/330

(58) Field of Classification Search ..... 297/339, 297/344.15, 344.17, 313, 316, 330, 344.14
See application file for complete search history.

(56) References Cited

U.S. PATENT DOCUMENTS

| | | | | |
|---|---|---|---|---|
| 1,187,745 | A | 6/1916 | Kerr | |
| 2,919,744 | A | 1/1960 | Tanaka | |
| 3,250,569 | A * | 5/1966 | Gaffney | 297/330 |
| 3,934,929 | A | 1/1976 | Rabinowitz | |
| 4,231,614 | A | 11/1980 | Shaffer | |
| 5,161,812 | A | 11/1992 | DeWeese | |
| 5,178,025 | A | 1/1993 | Bennett et al. | |
| 5,513,867 | A | 5/1996 | Bloswick et al. | |
| 5,626,389 | A * | 5/1997 | Logan, Jr. | 297/250.1 |
| 5,709,364 | A | 1/1998 | Araki et al. | |
| 5,730,494 | A | 3/1998 | LaPointe et al. | |
| 5,782,533 | A | 7/1998 | Fischer et al. | |
| 5,927,679 | A * | 7/1999 | Hill | 248/588 |
| 6,113,188 | A | 9/2000 | Stewart et al. | |
| 6,347,778 | B1 | 2/2002 | Koga et al. | |
| 6,449,783 | B1 * | 9/2002 | Moser | 4/667 |
| 6,488,337 | B1 | 12/2002 | De Voss et al. | |
| 6,578,920 | B2 | 6/2003 | Delmas et al. | |
| 6,783,179 | B2 | 8/2004 | Komura et al. | |
| 7,021,713 | B2 | 4/2006 | Kao et al. | |
| 7,066,540 | B2 | 6/2006 | Minai et al. | |
| 2005/0116519 | A1 | 6/2005 | Wullum | |

FOREIGN PATENT DOCUMENTS

| | | |
|---|---|---|
| DE | 41 29 497 | 3/1993 |
| EP | 1 310 227 | 5/2003 |
| FR | 2 724 299 | 3/1996 |

OTHER PUBLICATIONS

International Search Report dated Nov. 18, 2004.

* cited by examiner

*Primary Examiner* — Sarah B McPartlin
(74) *Attorney, Agent, or Firm* — Andrus, Sceales, Starke & Sawall, LLP

(57) ABSTRACT

A raiser seat for assisting a person from a sitting to a standing position is described. The seat comprises: a seat frame (4); a seat (10) supported for movement relative to the seat frame between a lowered position and a raised position; and a movement mechanism for moving the seat between the lowered and the raised positions. The movement mechanism comprises at least one cam (104) and the seat rests on the at least one cam such that rotation of the at least one cam results in movement of the seat relative to the seat frame.

39 Claims, 17 Drawing Sheets

FIG. 2
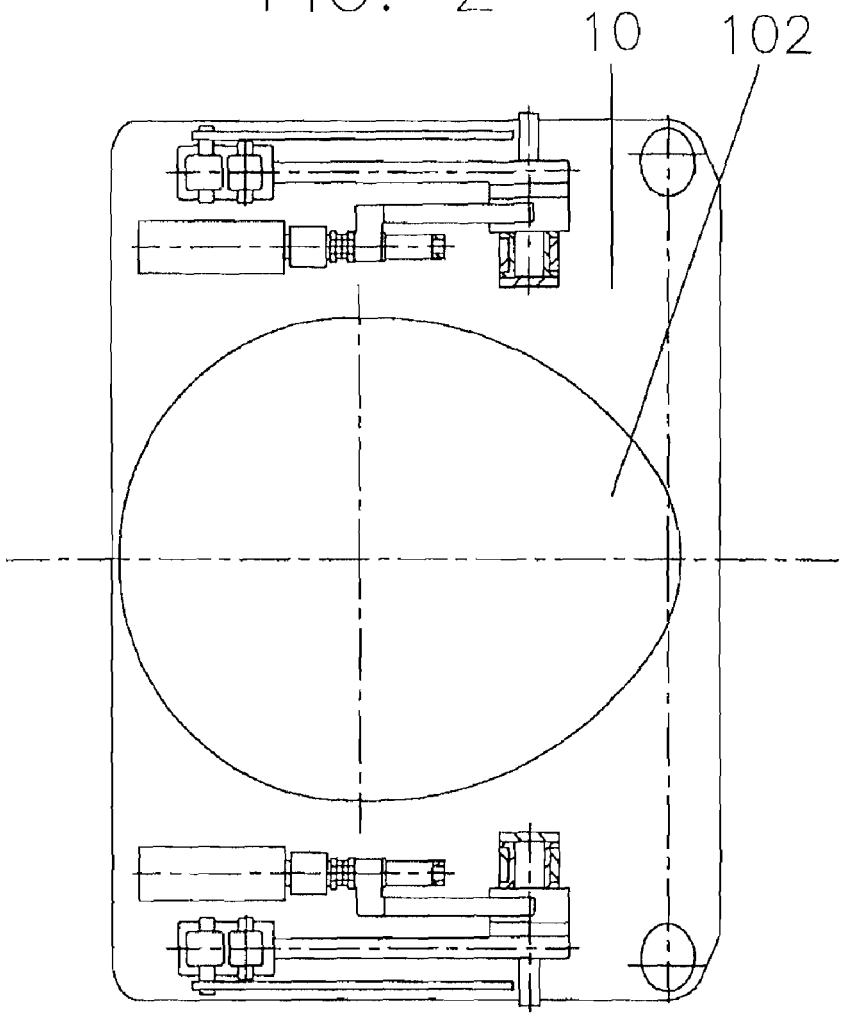
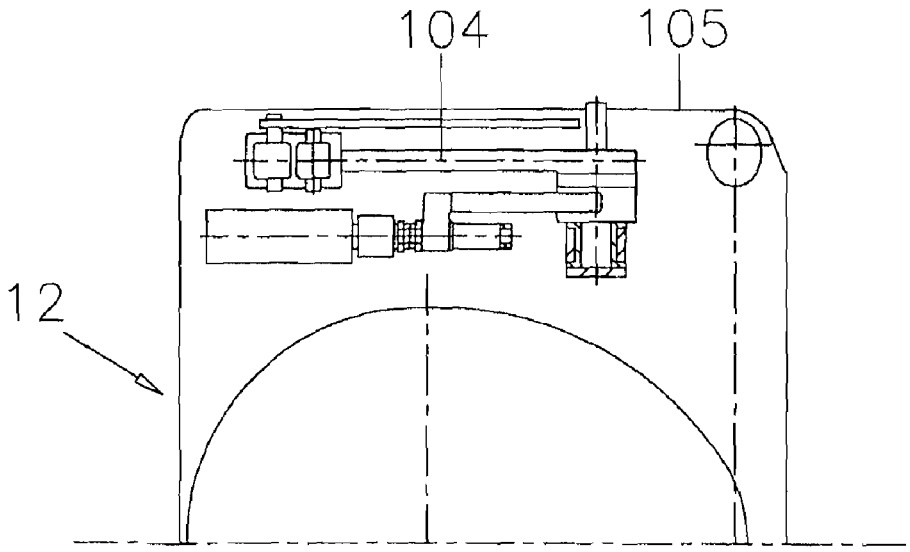
FIG. 3

VIEW DOES NOT SHOW SIDE PROFILE OF CAM BLADES

VIEW DOES NOT SHOW SIDE PROFILE OF CAM BLADES

RAISER SEAT

CROSS-REFERENCE TO RELATED APPLICATIONS

This application is a continuation of U.S. patent application Ser. No. 10/568,599, filed Jan. 3, 2007, now U.S. Pat. No. 7,600,815 which is the U.S. national stage application of International Application PCT/GB2004/003531, filed Aug. 17, 2004, which international application was published on Mar. 3, 2005, as International Publication WO2005/018522 in the English language. The International Application claims priority of Great Britain Patent Applications 0319533.6, 0319526.0 and 0319538.5, filed Aug. 18, 2003.

BACKGROUND

The present application is directed towards raiser seats for assisting a person from a sitting to a standing position. It is particularly applied to raiser seats in which the motion of the seat is determined by cams.

A variety of seats which can be raised or lowered in order to assist people from a sitting to a standing position are known. These are applied in many fields, and are of particular use in recovery from operations or for people with limited abilities. These seats may be a simple chair, or may also be used in medical transfer chairs, commodes or wheelchairs.

An example of a raiser seat is discussed U.S. Pat. No. 5,513,867 (Bloswick et al). This patent relates to a seat-lift wheelchair. The seat can pivot about its front edge to assist a person in standing up. The lift of the seat is achieved by the action of a tension spring pulling on a cable. The cable acts around a cam attached to the bottom of the seat. This cam determines the effective distance of the tension in the cable from the pivot point in the seat. It therefore allows the torque to be varied depending on the position of the seat.

This mechanism requires a large tension spring in order to generate the required torque. It will also only function correctly when the pivot point of the seat is fixed relative to the seat frame and the tension spring.

SUMMARY

The present invention provides a raiser seat in which the seat rests upon cams which are attached to the seat frame. These cams can be rotated to lift the seat.

According to a first aspect of the present invention, there is provided a raiser seat for assisting a person from a sitting to a standing position comprising:

- a seat frame;
- a seat adapted for movement relative to the seat frame between a lowered position and a raised position; and
- a movement mechanism for moving the seat between the lowered and the raised positions;
- wherein the movement mechanism comprises at least one cam and wherein the seat is supported by the at least one cam such that rotation of the at least one cam results in movement of the seat relative to the seat frame.

The term "cam" includes single and multiple bladed and lever-type cams. Lever-type cams can have one or more tracks, conveyers, rollers/casters/wheels, roller type or plain bearings, or linear slides that act to set the effective profile of the lever, thus achieving the same function as a cam.

Unlike U.S. Pat. No. 5,513,867, the seat is supported by the cam, rather than the cam being fixed to or part of the seat. This means that rotation of the cam causes the seat to move. During this movement there can be relative movement between the seat and the cam. The profile of the lift (including tilt and/or translation) can be determined according to the profile of the cam. In this way the cam is directly responsible for movement of the seat, rather than being indirectly responsible for movement of the seat due to the action of a tension cable as in U.S. Pat. No. 5,513,867.

Preferably, the seat forms part of a seat unit. This allows the seat to be permanently or removably attached to the seat frame, depending on the particular application.

Preferably, the at least one cam is retained within the seat unit. Thus, the seat and cam can easily be incorporated into a finished seat unit. It also has the advantage that the seat unit can be changed to allow different cam profiles to be used with the same seat frame. In one embodiment, the at least one cam is rotatably fixed to the seat unit.

Preferably the seat unit comprises at least one reinforcing element. The reinforcing element acts to increase the rigidity, strength, and general practicalities of the seat unit.

Preferably the seat and/or seat unit can be mounted on the seat frame by sliders in one embodiment. Protrusions and/or invasions (grooves) of different shapes and forms for location of the seat and/or seat unit can also be used. The seat and/or seat unit can be horizontally or vertically slid or placed in positions. Locking mechanisms can also be provided.

Preferably, the movement mechanism comprises a pair of coaxial cams. These cams can be located on either side of the seat and therefore spread the load of a person sitting on the seat evenly between them.

Preferably, the movement mechanism comprises a first pair of coaxial cams located supporting a rear end of the seat and a second pair of coaxial cams supporting a front end of the seat. By using two pairs of cams, one towards the rear and one towards the front, the lift profile can be varied almost infinitely. The profiles of the cams will determine the movement profile of the seat. This can vary considerably, because the use of cams means that a fixed pivot point is not required.

Preferably, the raiser seat further comprises a motor for rotating the at least one cam. The motor can be located anywhere within raiser seat, and may be contained in a separate detachable casing. For example, it can be side-by-side, above or below the cam, or contained within the seat unit. The motor may drive the cam directly or indirectly. With an indirect drive various drive transfer components can be used, including drive couplings and meshed gears. If the motor drives the cam indirectly, the power transfer components can be chosen to allow the drive to be transferred from wherever the motor is located. Furthermore the drive transfer components can be also be chosen to alter the characteristics of the mechanism, for example the torque or rotational speed. The motor can be controlled via a control box for all required operational parameters.

Preferably, the at least one cam is attached to a coaxial gear in meshed engagement with a rack such that translation of the rack results in rotation of the at least one cam.

Preferably, the rack is driven by a gear powered by a motor.

Preferably, the profile of the at least one cam is chosen dependent on the path followed by the seat as it moves between the first and second position. This allows the motion of the seat to be tailored to specific purposes by the choice of cam profile. Thus, for example, the combination of lift, tilt and cycle time/speed of operation of the seat can be varied as required for a particular application. Alternatively, a set of predetermined cams and/or control programs can be provided giving a range of common movement profiles.

Preferably, the movement mechanism further comprises at least one actuator fixed at a first end to the seat. In one embodiment a second end of the actuator is fixed to either the seat frame or the seat unit, and the second end can move relative to the first end in a generally vertical direction. An actuator is a simple way of achieving translation. In some circumstances, part or all of the seat may be required to mostly translate in a single direction. A combination of the least one cam with the at least one actuator is a simple way to achieve this motion. A further advantage is that the overall operating range and capability of the at least one cam can be maximised.

Preferably, the at least one actuator comprises at least one threaded member in meshed engagement with at least one gear driven by a motor. The at least one actuator can also be a lead screw. Reinforcing elements can be located in a housing for the at least one actuator.

The seat and/or seat unit can include an aperture. The seat can then be used as a commode. In one embodiment, the seat and/or seat unit are not permanently attached to the seat frame. Preferably, the seat frame and/or the seat unit can then include a removably attached soils receptacle to sheath and enable easy emptying of the commode. The soils receptacle can have a cover to enable clean usage of the seat and reduce risk of contamination further by offering the sheath facility for one or more of the frame, seat unit and user environment with soils.

Preferably, the seat frame is mounted on wheels or sliders. This allows movement of the seat from one location to another, and allows use of the seat as, for example, a wheelchair, or alternatively to move the seat to where it is required to be used.

Preferably, when the seat frame is mounted on wheels, the raiser seat can further comprise a brake system. The brake system can be operative to prevent motion of the wheels during a lifting or lowering operation of the seat, or any other use which requires the seat to be held stable without moving, or any other use that requires the seat/frame. This can improve the safety in use of the seat.

Preferably, the brake system is associated with the movement mechanism, such that operation of the movement mechanism causes the brake system to act to prevent rotation of the wheels. This can provide a further safety advantage, by ensuring that when the movement mechanism is operated, the brake system is automatically applied.

Preferably, the at least one cam either incorporates a friction reducing coating or is manufactured at least partially from a friction reducing material. In embodiment, the whole of the at least one cam is manufactured from a friction reducing material.

Preferably, the at least one cam is linked to the seat in a way which does not significantly alter the load on the movement mechanism.

In one embodiment, this is achieved by the use of a fixed connecting member (or protrusion) extending from the at least one cam. Preferably the connecting member is an extension of roller shafts of the at least one cam. The connecting member can locate within a corresponding slot in the seat and act to support the seat on the at least one cam. It can also prevent the seat from moving away from the at least one cam without significantly altering the load on the movement mechanism.

In an alternate embodiment, at least one single or double action pneumatic or hydraulic cylinder can connect the at least one cam and the seat. The cylinder can feature an orifice with dimensions chosen so as to avoid placing any further loads on the movement mechanism, yet give sufficient resistive load to prevent the seat moving away from the cam. In the event that a load is placed on the seat such that it becomes detached from the cam profile edge, the fluid within the cylinder will begin to exit the orifice at a higher rate and thus place a resistive load on the seat's movement away from the cam profile edge.

The resistive load will continue to be applied until the seat moves sufficiently far that the pneumatic cylinder is extended to the limit of its stroke, or the load case is reversed and the seat regains contact with the cam.

Preferably, the at least one cam comprises at least one of the following features: an integral gear; an integral shaft; an integral bearing; an integral bearing surface; an integral roller; a one roller assembly; at least one connection member; a roller carriage; an integrated roller carriage in whole or in part; an integral roller track; an integral seal; integral sealing surfaces or sealing area; an at least one integral location and retention component; a blade; a shaft recess; a bearing recess; a protrusion recess; an externally threaded member; an internally threaded member; one hole; one roller type or plain bearing/bush; one press fit member; one threaded member; one taper edge profile; one alternative edge profile; one increased thickness section that can run the full length of the cam; and multiple blades More preferably, in the event that the cam comprises more than one blade, the integral location and retention component can be an area at either side of a main cam and/or the integral gear can have a different diameter, size, form or shape from that of other sections of the cam shaft.

Preferably the seat comprises a guide track adapted to receive the connecting member. In one embodiment the guide track comprises a linear track located at the side of the seat in a position where the seat is supported by the at least one cam. In another embodiment, the seat can further comprise at least one thickened material section, roller, a bearing, a friction-reducing coating, or a friction reducing material, positioned along the part of the seat which is in contact with the at least one cam. If at least one roller or bearing is used, the track can be mounted on the at least one roller or bearing.

Preferably, the seat unit is removably attached to the seat frame. The attachment mechanism can include connections for electrical circuitry. These connections can be encapsulated within the seat frame. The connections can be for power, sensors, control or other functions.

Preferably, the seat frame comprises handles. The handles can be placed at various locations to allow for safe interaction with the user or operator, and allow for controlled and safe movement and location with other components and assemblies.

Preferably, the seat frame comprises footrests.

BRIEF DESCRIPTION OF THE DRAWINGS

Embodiments of the invention will now be described by way of example only with reference to the accompanying drawings, in which:

FIG. 2 depicts a plan view of the seat of a first exemplary embodiment of the present invention, cut away to show the movement mechanism in plan view;

FIG. 3 depicts a more detailed view of one half of the movement mechanism shown in FIG. 2;

DETAILED DESCRIPTION OF THE DRAWINGS

Figure 1:
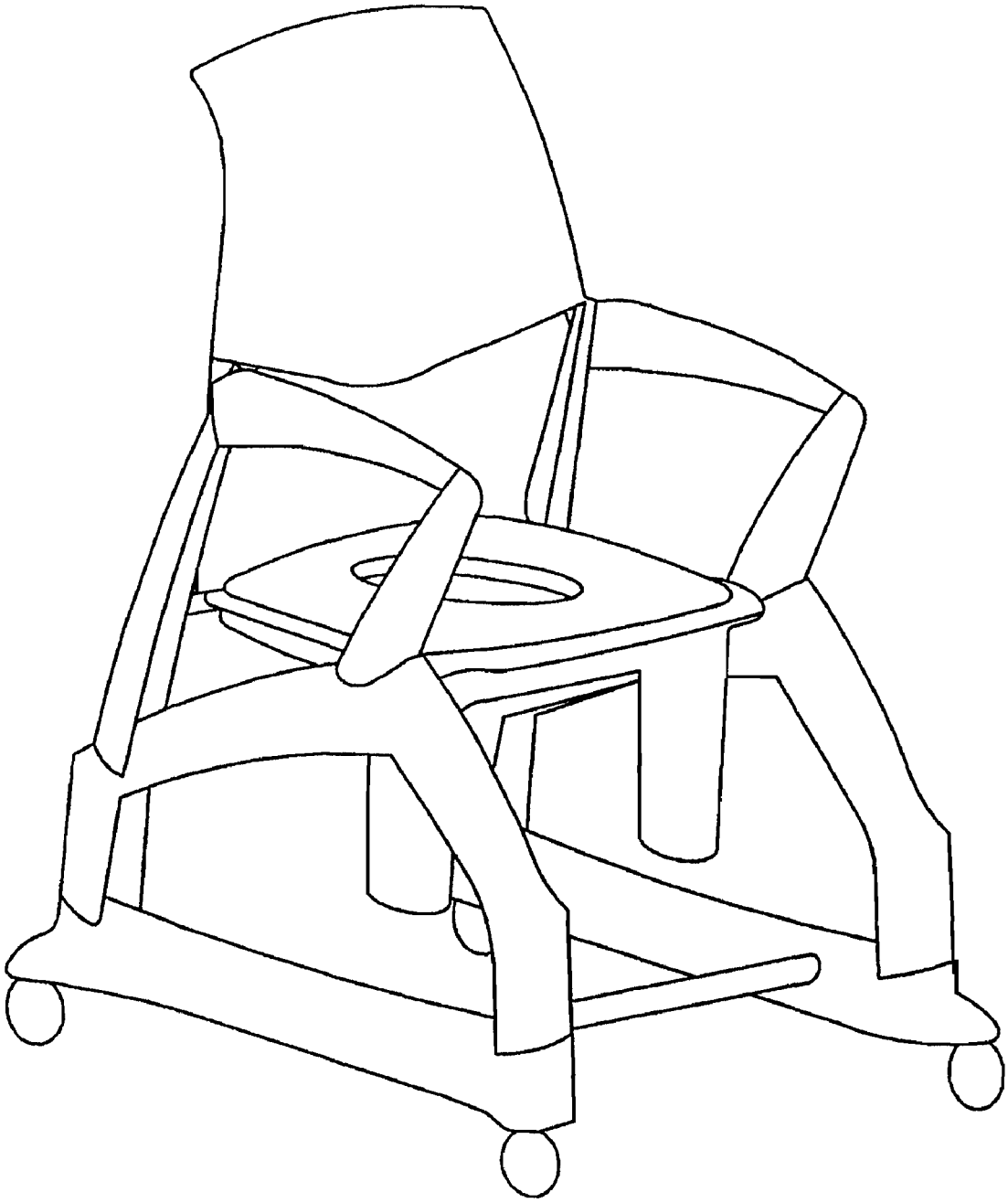
FIG. 1 depicts a perspective view of a first exemplary embodiment of the present invention.

FIG. 1 depicts a side view of a first embodiment of a complete raiser seat 2 according to a first exemplary embodiment of the present invention. The raiser seat 2 has a seat 10 which forms part of a seat unit 12. A seat frame 4 includes a back rest 6 and arms 8. The seat 10 and seat unit 12 are supported by the seat frame 4.

The back rest 6 can tilt, either by its manufacture from an appropriate flexible material, or through the provision of a pivot point or via connection to a further pivoting joint component or assembly.

Movement of the chair is assisted by wheels 14 located on the bottom corners of the seat frame. The seat frame can include handles that can be located at any point on the seat frame, to allow for safe interactions with the user, interaction with operators and users for accurate controlled movement and location with other components and assemblies.

The mechanism by which the seat 10 is raised and lowered will now be explained. FIG. 2 shows a plan view of the seat 10 with the lifting mechanism below it. FIG. 3 shows a close up of one half of the lifting mechanism shown in FIG. 2.

As shown in FIGS. 2 and 3, the seat 10 and the seat unit 12 include an aperture 102 to allow its use as a commode.

Figure 6:
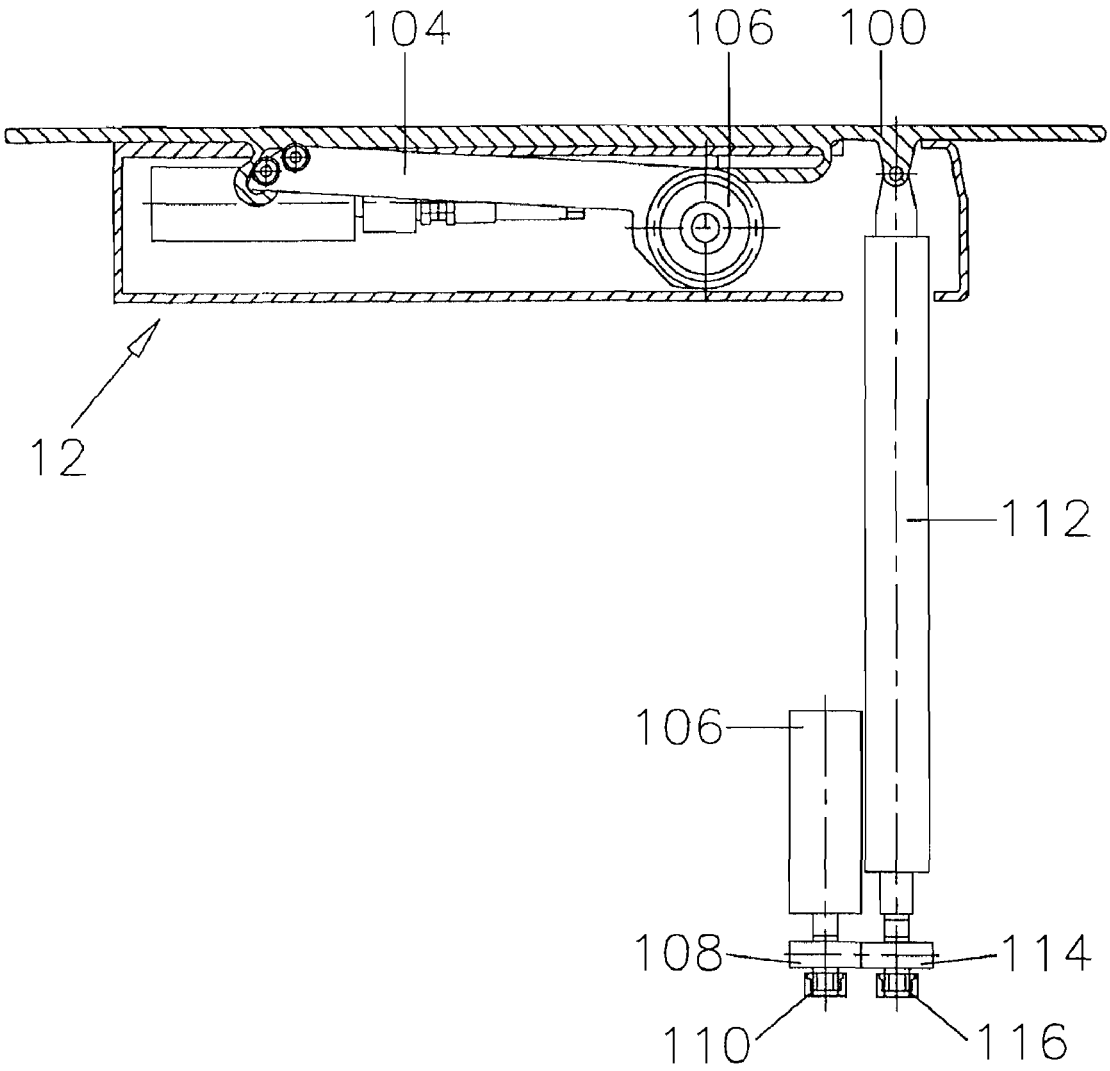
FIG. 6 is a side view of the movement mechanism of a first exemplary embodiment of the present invention.
Figure 7A:
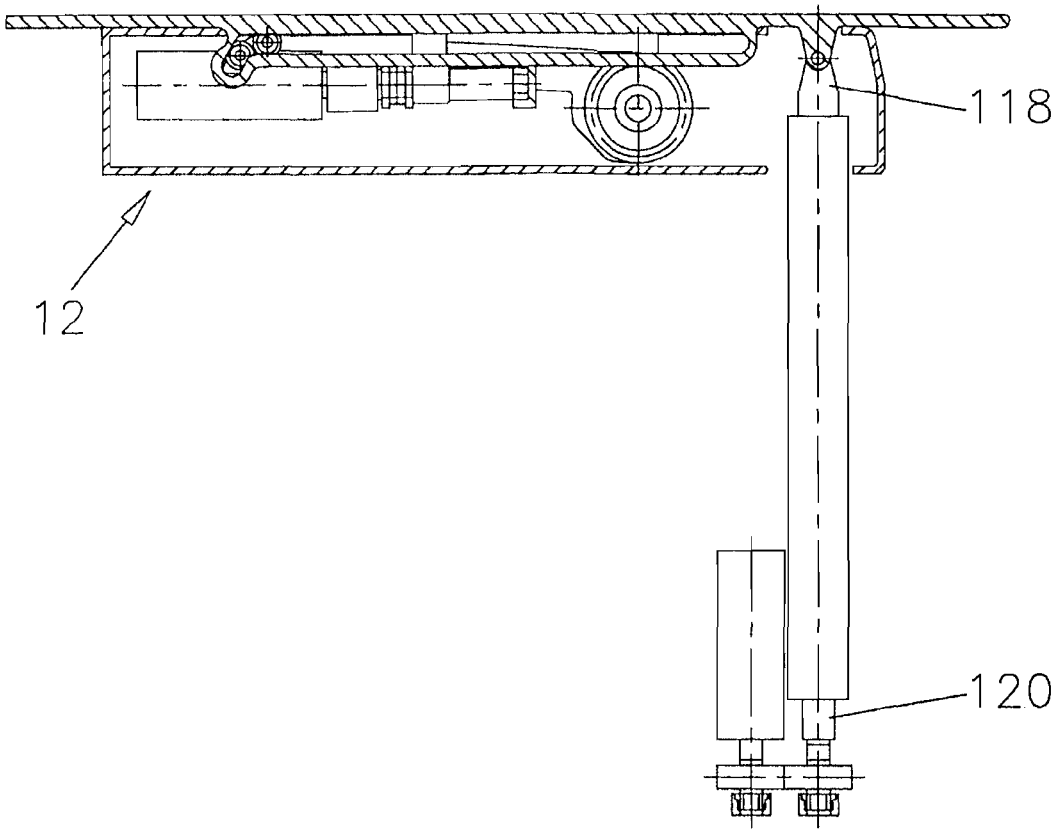
FIGS. 7A and 7B depict a cross sectional view of the movement mechanism depicted in FIG. 6, showing the guide track provided on the seat in a first embodiment.
Figure 7B:
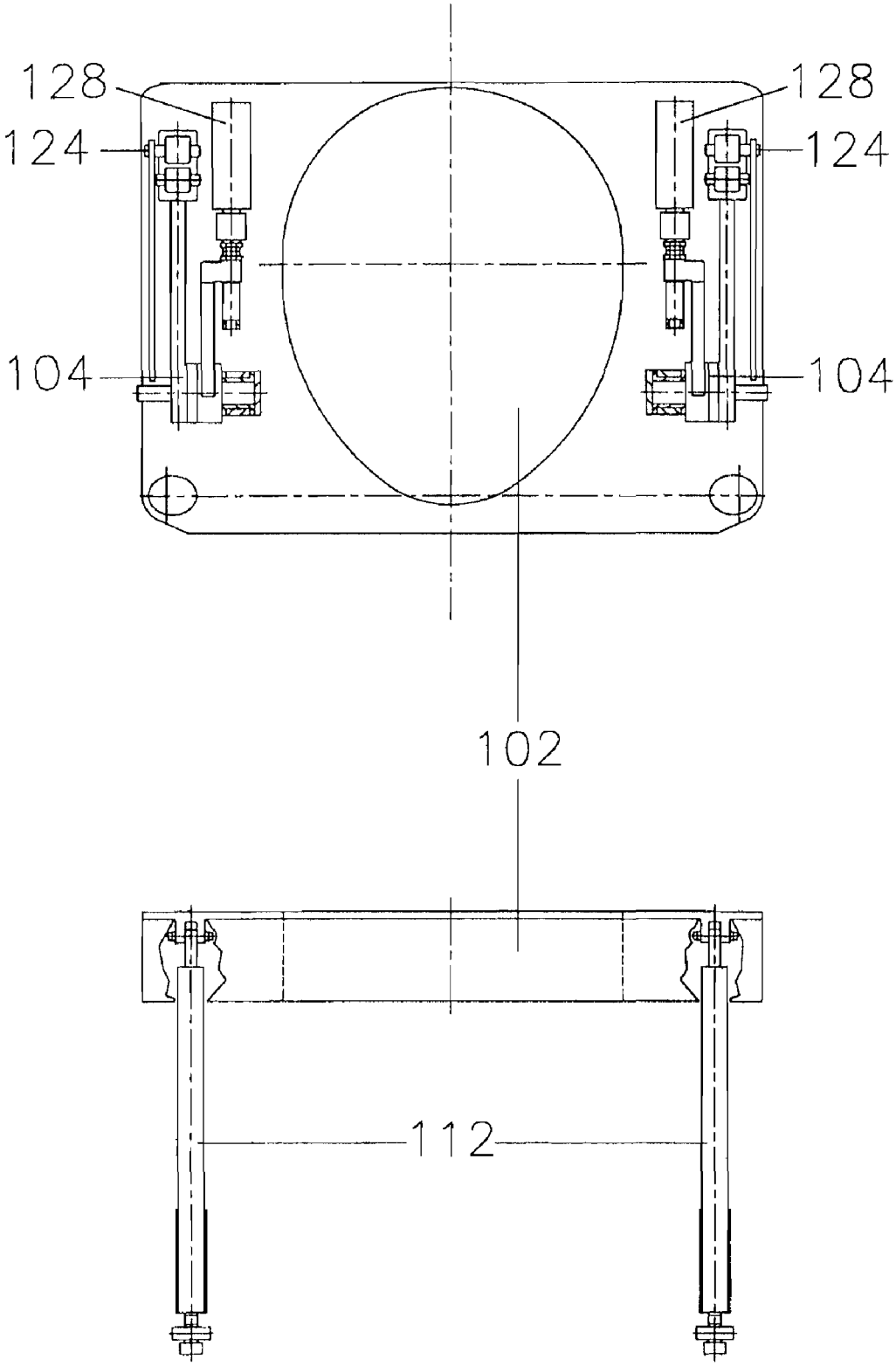

FIGS. 6 and 7 depicts a side view and a cross section, respectively, of the lifting mechanism. A front mounted lifting mechanism 112 is located either side of the aperture 102 and comprises two main actuator parts 112 on each side as can be seen in FIG. 7B. The actuator 112 is pivotally attached towards the front of the seat 10. This allows movement of the front of the seat 10 in a generally vertical direction. At least one cam 104 supports the seat 10 further towards the rear than the actuator 112. Rotation of the cam 104 causes vertical movement and/or tilting of the seat 10 depending on the relative movement of the point of contact between the seat 10 and the cam 104 and the pivotal connection to the actuator 112.

The actuator 112 is threaded. In this embodiment a lead screw 120 is used internally to the actuator and is moved by rotation of a gear 114. The gear 114 is meshed with a gear 110 which is powered by an electric motor in this embodiment, although other types of power source are also possible.

Figure 4:
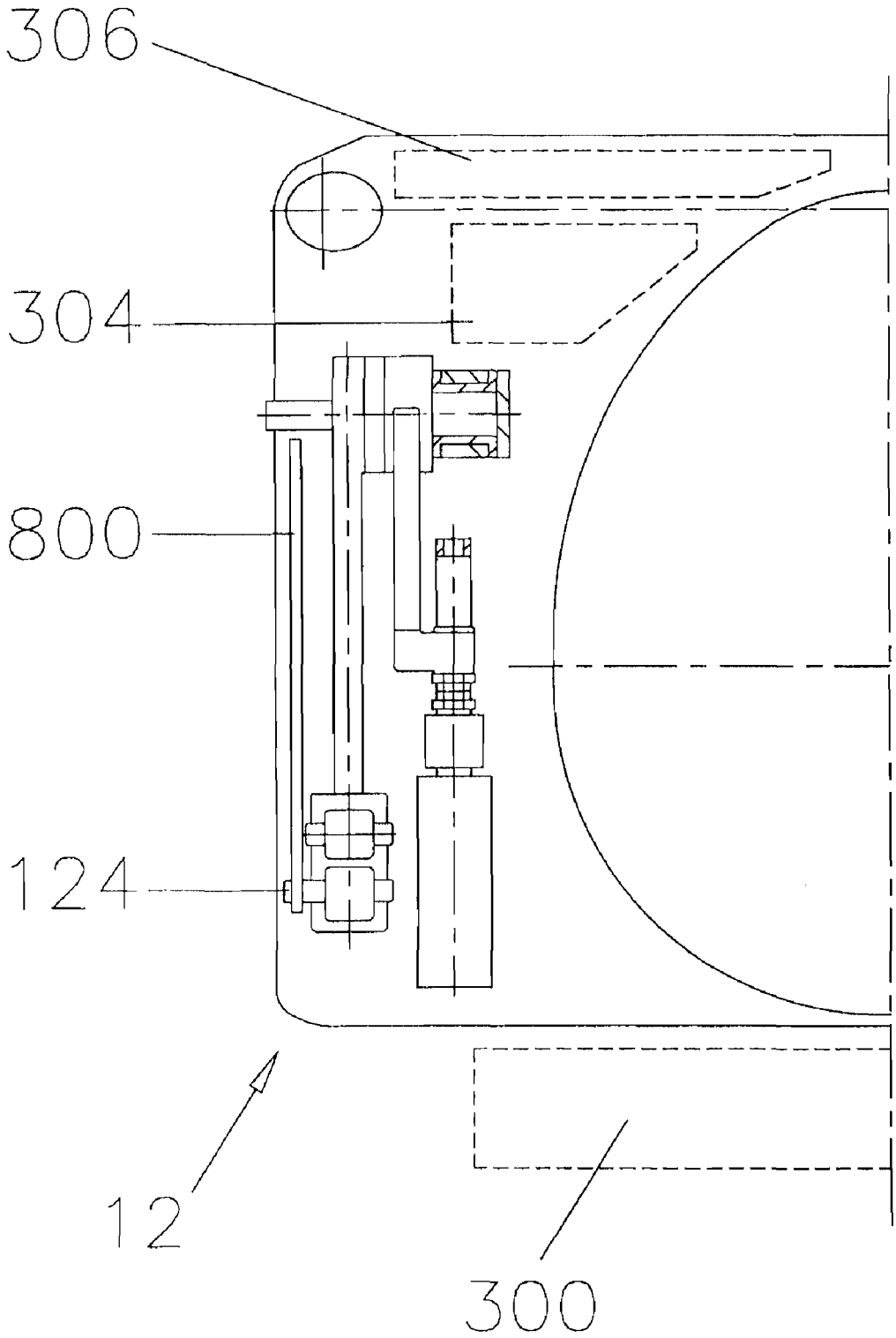
FIG. 4 depicts possible battery, control box and motor positions in a first exemplary embodiment of the invention.

As shown in FIG. 4, the power source for the motor can be located at various locations, and preferably at the locations denoted 300 and 306. Likewise, the control box can also be located at various locations, and preferably at the locations denoted by 304 and 300. In FIG. 4, reference numeral 105 serves to demonstrate the boundary of the seat unit.

The control box, any sensory equipment and the battery are connected to the motors in the mechanism by any suitable means, such as a removable cable or a fixed cable. This applies no matter what their location is, whether in close proximity 304, 306 to the movement mechanism, at a larger distance, or external to the seat unit 12, suitable connection can always be provided by appropriate means.

Figure 5A:
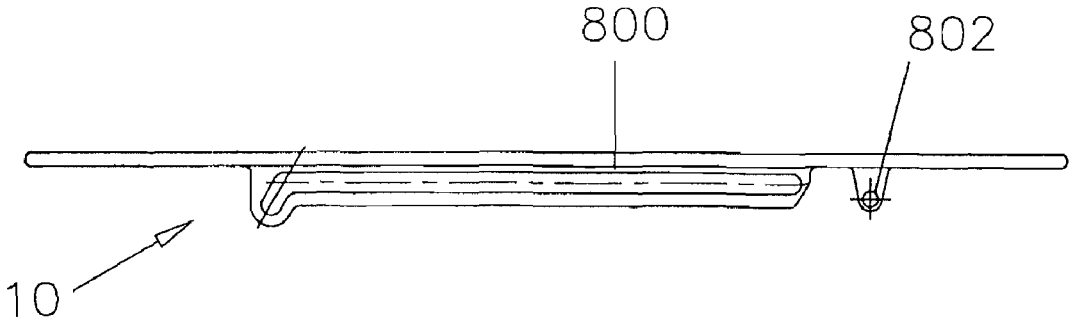
FIG. 5A depicts side a view of the seat used in a first exemplary embodiment of the invention.
Figure 5B:
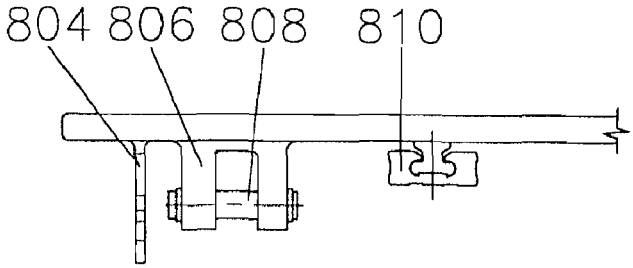
FIG. 5B; depicts a front view of one side of the seat depicted in FIG. 5.

FIGS. 5A and 5B show the main features of the seat 10 in this embodiment. The seat 10 comprises features which can either be separate components that are fixed to the seat or integrated in whole or in part in the manufacturing process. In this embodiment this is particularly true of the guide track 800 which receives a connecting member 124 (or protrusion) attached to the cam 104. This allows the safe use of cams with no load increase on the mechanisms; this system allows the seat to effectively float on the cam whilst incurring little, if any, mechanical losses.

Figure 12A:
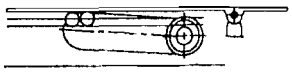
FIGS. 12A to 12J illustrate various positions in the motion of a seat from the lowered to a partially raised position according to a first exemplary embodiment of the present invention.
Figure 12B:
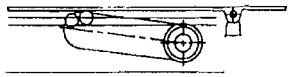
Figure 12C:
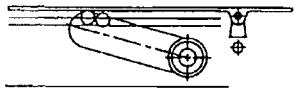
Figure 12D:
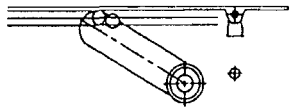
Figure 12E:
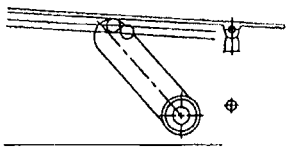
Figure 12F:
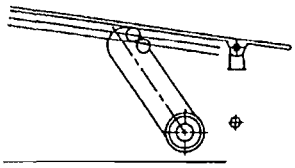
Figure 12G:
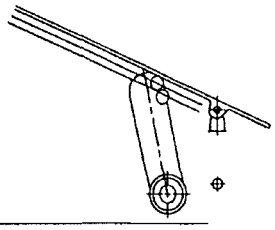
Figure 12H:
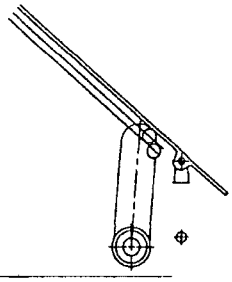
Figure 12I:
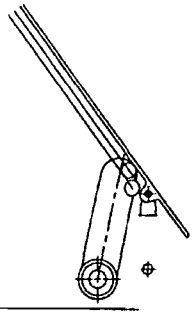

A pivot point 802 allows for removable attachment of the actuator 112 suitable for lift and pivot operations associated with seat movement as illustrated in FIG. 12A-12 J, which is described in more detail later. Other types of actuator than the actuator 112 with lead screw 120 may also be used.

The removable attachment is achieved in this embodiment by an assembly 808 comprising a plain shaft with an internal or external threaded section that interfaces with a second member with an internal or external threaded section. Other components can also be used in this assembly. These include plain washers, washers that exert circumferential force under load, self locking internally threaded members, and members that exhibit radial force exertion for position and interactive stability. These components can have inner diameters below the outer diameter of the plain shaft, an outer diameter in excess of the plain shaft and be fitted in a groove or undercut to the plain shaft.

The function of assembly of 808 can also be provided by members which exhibit an interference relationship to form a permanent connection.

A seat track 810 is provided at the point at which the edge profile of the cam 104 contacts with the seat. This can be formed as an integral part of the seat at manufacture. The seat track 810 will preferably consist of a thickened material section manufactured in the same material as the seat. Alternatively it can be manufactured at the same time as the seat in whole or in part of a friction reduction material. The track can also be coated after the original source manufacturing process with a friction reducing coating.

A number of possible alternate constructions of the seat track will now be described. The seat track can consist of rollers and/or linear slides and/or track rollers and/or wheels and/or castors. If rollers and/or wheels and/or casters are used, they will be either permanently attached or removably attached to the seat over the given length of the cam/seat interaction (see for example that depicted by FIGS. 12A-12J and described in more detail below) and spaced such that the resultant action of the seat is smooth and with no undulation. If linear slides are used, preferably at least one will be used at each cam/seat interface. The linear slides will be attached to the seat via threaded or interference members such that the smooth and reduced friction parameters of the linear slide system are exploited.

In another alternate construction of the seat track, the predefined roller system includes the addition of a flexible or rigid, continuous or unconscious track that can be either captivated or non-captivated and is situated between the rollers and the cam 104. The track is such that the distance between each roller for smooth seat tilt and lift can be increased over that of a system using pure rollers. The increase in permissible roller pitch is such that fewer rollers are used and with the interaction of the track, there is little detriment to the smoothness of seat operation. The seat track can be profiled to suit the profile of the cam and aid in smooth, safe operation with reduced mechanism load friction characteristics. Combinations of these seat track constructions can also be utilised.

Returning to the description of the movement mechanism, the pivot and lifting of the seat is taken around the point 802. The pivot and lift assembly 808 is of sufficient strength to withstand the loads generated by operation of the raiser seat 2 in predetermined limits. The assembly 808 may include a plain or roller type bearing and/or a friction reducing coating and/or be manufactured from a friction reducing material. The assembly 808 is housed within a structurally sufficient, integrated and/or fixed member. The member can be integrated at manufacture with the same or a different material. The material can have friction reducing properties and structural capabilities or just structural capabilities, providing it can retain the connection member of the actuator sufficiently in all planes except that of the required rotation around the pivot point axis.

The member housing the assembly cane be a separate component which is fixed to the seat via welding and/or bonding and/or a mechanical fastening and/or a slider and/or and interference fit. In that case, the fits need to be suitable for all the required usage of the product during the operation of the unit.

FIG. 6 shows the preferred cam mechanism, which in this embodiment is driven by an electric motor. The cam 104 has a gear 106 coaxially removably or permanently attached to it, either so that the gear 106 and the cam 104 share a common axis of rotation and rotation of the gear results in rotation of the cam. This gear is then driven by a toothed rack. The toothed rack is itself driven by the operation of a lead screw or worm drive connected/meshed with a gear connected or meshed to an electric motor.

FIGS. 6 and 7 also depict more detail of the actuator. It can be observed that the actuator 112 is preferably a casing in which a lead screw 120 removably or permanently captivated. The lead screw operates via removably or permanent connection to a gear 114 meshing with gear 108 which is driven by the electric motor 107. The whole assembly is located on bearings or friction reduction material that both holds the units securely whilst allowing rotation with minimum friction. The bearings can be roller type bearings where cylindrical or spherical components are utilised and/or plain bearings and/or have friction reduction coatings.

In FIG. 7 the connection members of the actuator system are show. A top connection member 118 is provided which can be removably or permanently attached to the seat pivot assembly 808 in such away as to allow the pivot action of the seat. In this embodiment the end is tapered to make sure that no encroachment on the seat occurs at any point during the operating cycle of the mechanism. The lead screw 120 is held captive within a casing.

The lead screw 120 has sufficient thread characteristics to achieve the desired performance of the complete unit. The lead screw 120 comprises an externally or internally threaded bar and engages with an internally or externally threaded seat or main bar connection member 118. The two members exhibit meshing thread patterns.

The connection member 118 is of hollow cylindrical form with a threaded section or with a complete threaded length from an open end. The open end is the opposite end to the seat connection end. The thread of the lead screw 120 can mesh with the threaded section of the connection member 118 and when rotation is applied to the lead screw the connection member 118 thread advances or retracts along the length of the lead screw 120. The lead screw 120 is able to enter the hollow section of the connection member 118 to a depth equal or above that of the overall required stroke. Lubrication can be added to the system to ensure friction reduced running and higher mechanism efficiency.

FIG. 7 also depicts a cross-section through the seat portion 12 and the seat 10 to reveal the inner workings of the movement mechanism and the interaction between the seat guide track 800, the cam and the connection member 124. In this embodiment the seat is securely linked to the cam via a connection member 124. This securely retains the seat to the cam to allow temporary breaks or permanent connection of the cam profile, whether it be roller, bearings, tracks, wheels, casters or any other such profile interface and a track formed on the seat. It therefore enables the temporary or permanent connection of the seat to the cam (a plan view can be seen in FIG. 4).

In this embodiment the seat is secured on the cam by the interface between a connection member 124 at the end of the cam and at least one guide track formed on the seat. This allows relative movement between the end of the cam and the seat, and ensures that the seat is not accidentally disengaged or otherwise removed from the cam. It has a further advantage of not yielding any further mechanism load during a lifting operation. The connection member 124 is such that the seat effectively just rests on the cam and hence the retention of the seat on the cam is achieved with little or no mechanical loss.

Figure 8:
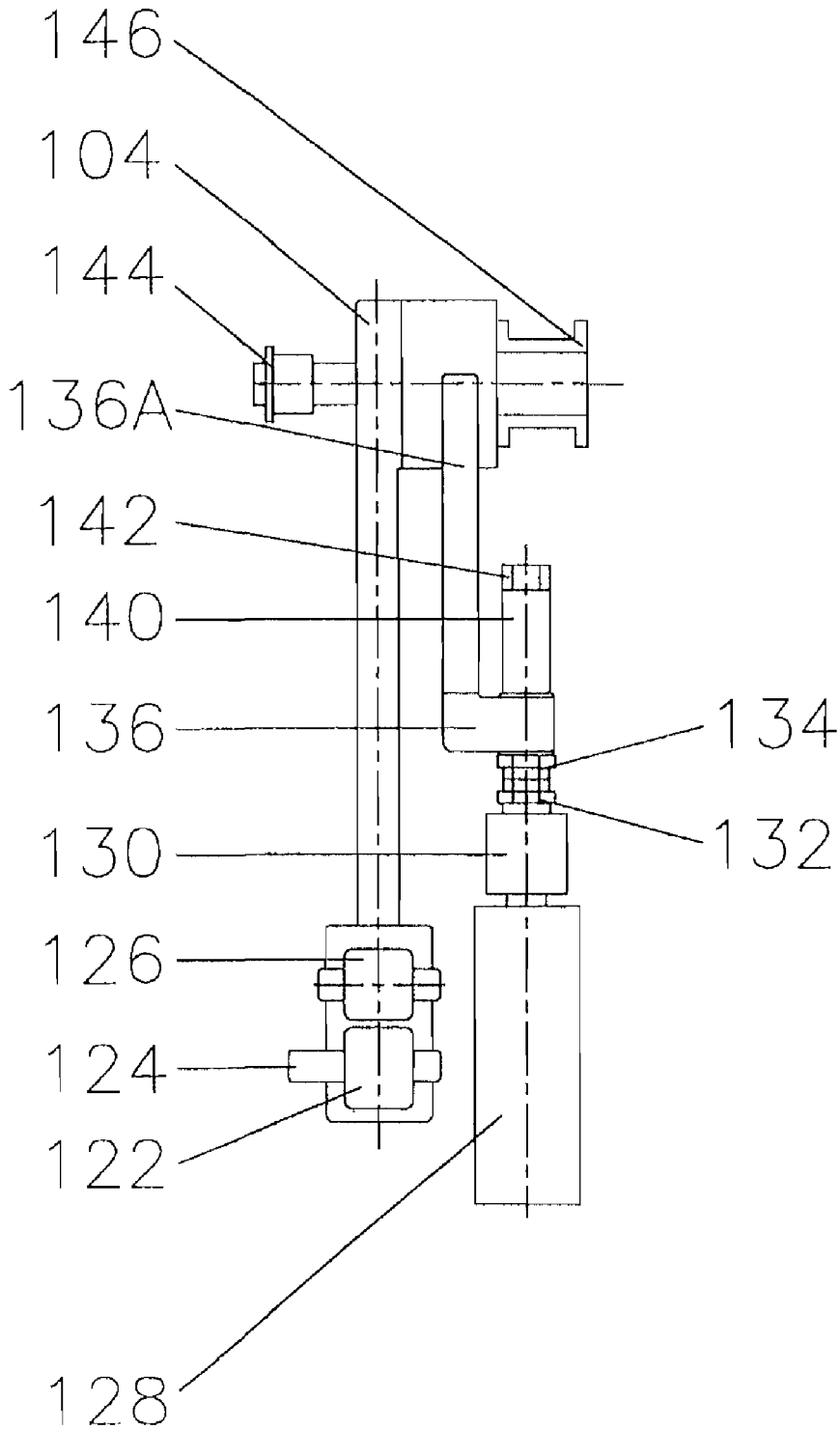
FIG. 8 depicts a plan view of the cam mechanism of a first exemplary embodiment.

The clearest view of the cam mechanism can be observed in FIG. 8, which depicts a plan view. The cam exhibits a wider member at the rear of the cam blade. This wide member houses the rollers and the connection member 124.

In this embodiment the connection member 124 forms an extension of one of the roller shafts of the cam blade. The connection member 124 preferably fits into the cam via an inference entrance into the cam shaft, into a recess sufficient to allow reduced friction usage.

The roller is of sufficient diameter and width to allow for effective operation. A number of alternate constructions of the roller can be used. Preferably, the roller consists of an outer diameter material which is located on a roller type or plain bearing. This is responsible for mating with the seat track. Thus, the position of the bearing axial pivot point in relation to the axial pivot point of the at least one cam forms the effective profile of the at least one cam. The bearing is in turn located on a shaft, the shaft may include an extended section such to allow connection with the seat guide track.

In an alternate construction of the roller, the outer diameter material may not be present, in that case the roller is than a roller type or plain bearing which is directly responsible for mating with the seat track. Thus, the position of the bearing axial pivot point in relation to the axial pivot point of the cam forms the effective profile of the cam. The bearing is in turn located on a shaft, the shaft may include an extended section to allow connection with the seat guide track.

In another alternate construction of the roller, the roller is integrated with the shaft which is responsible for mating with the seat track. Thus, the position of the roller axial pivot point in relation to the axial pivot point of the cam forms the effective profile of the cam. This integral roller/shaft format relies on the cam to provide sufficient friction reduction housing to ensure effective operation. As with other constructions of the roller, the integrated roller shaft may include an extended section which allows connection with the seat guide track.

The preferred roller housing section of the cam is preferably indicated by the increased wall section of the cam blade. This section can be made from a material different to that of the main cam and is preferably integrated at source/route manufacturing process.

To aid the effective rotation of the roller, preferably an increased wall thickness section integrated with the at least one cam can be manufactured in whole or in part from friction reduction material and/or can house roller type or plain bearings in the recesses for the rollers shafts to locate within. In this embodiment bearings of either type are preferably fitted first, then the roller is aligned with the centres of the bearings, the shaft is then located through the centres of the bearings and rollers. The bearings have an interference fit with the cam and the shaft has an interference fit with both the bearings and the at least one roller.

The shafts and bearings are such that they would be able to retained further once in position. For the shaft and bearings, this can be achieved by using further press and interference fit members and threaded sections, with plain washers or those that exert a circumferential force when under load; self locking internally threaded members; and members that exhibit an inner diameter below the outer diameter of the plain shaft and an outer diameter in excess of the outer diameter of plain shaft. They can be used in relation to their radial force exertion for position and interactive stability and fitted in a groove or undercut to the plain shaft.

In an alternate construction, the at least one roller and shaft are fitted to the at least cam blade via a recess as referenced previously. The shaft is seated within a recessed area, the recessed area comprising an integrated at manufacture or post-manufacture plain bearing. The plain bearing is made of material sufficient to withstand the loading and service requirements and yield reduced friction operation.

In another alternate construction the roller and/or bearing, with or without an outer of different or the same material is located on the cam blade 150 via a protrusion integrated with and stemming from the cam blade 150. The protrusion forms form an integral shaft on which to place the roller and/or roller type or plain bearing. In the case of the roller type or plain bearing the fit would preferably be that of an interference fit that may include bonding agent and other mechanical retention methods such as threaded members, threaded and locking members and members that exhibit inner diameters below the outer diameter of the plain shaft and an outer diameter in excess of the plain shaft and used in relation to their radial force exertion for position and interactive stability and fitted in a groove or undercut to the plain shaft. In this case the roller type bearing or plain bearing could be retained via a press fit component.

In other constructions the at least one protrusion allows for the roller with a plain type bearing to be securely fixed within to form a new roller internal diameter that corresponds to that of the inserted plain bearing, or an integrated at source of manufacture plain type bearing. In both cases the bearing will preferably be of a material with friction reducing properties or the at least one protrusion itself will consist of material that of friction reducing properties and structural rigidity suitable for purpose and which can be integrated with the cam blade 150 at the source of manufacture or such that the plain bearing can be fixed to the protrusion. In all cases the roller is preferably secured to the protrusion by an interference fit that may include bonding agent and other mechanical retention methods. such as threaded members, threaded and locking members and members that exhibit inner diameters below the outer diameter of the plain shaft and an outer diameter in excess of the outer diameter of the plain shaft and used in relation to their radial force exertion for position and interactive stability and fitted in a groove or undercut to the plain shaft and or further members retained via a press fit to the at least one protrusion.

In all the constructions describing at least one roller and/or bearing, protrusions and or recesses, it is known that the multiple examples can be utilised on the at least one cam blade present on the at least one cam. Those multiple examples can be distributed across the length of the at least one blade and/or the at least one cam at points relative to the axial rotational point of the at least one cam and thus the at least one profile can be achieved.

In an alternate construction of the cam, the at least one cam can have multiple blades. Located between the blades is either a continuous shaft that runs between the blades, or two non continuous shafts located as a protrusion on each blade. The preferred format is that of two blades, the description of which can also be applied to any additional blades.

This alternate construction can be manufactured in one piece as a completely integral member or in several sub sections that are later joined. The joining process can be completed via welding, interference fit between protrusions and corresponding recesses on each part, and/or more traditional mechanical means. This includes employment of mechanical retention methods such as threaded members, threaded and locking members and members that exhibit inner diameters below the outer diameter of the plain shaft and an outer diameter in excess of the plain shaft and used in relation to their radial force exertion for position and interactive stability and fitted in a groove or undercut to the plain shaft and or further members retained via a press fit.

In the case of integrated manufacture, the roller can be placed between the blades and aligned to correspond with at least one hole centre in each of the blades. It is preferred that a shaft is then pressed through the assembly via the holes in the blades with an interference fit thereby created between the at least one shaft and the at least one hole in each blade.

Roller type or plain bearings can be located in the hole in the cam blade such that friction reduction is present in the system. In this embodiment an interference fit is created between the roller and the shaft at the shaft pressing in a similar manner to that of the above-described blade/shaft interactions.

In the case that bearings in the cam blades are incorporated, the roller preferably has an interference fit with the shaft. The roller can feature at least one integral roller type or plain bearing. In that case preferably no bearings are present in the cam blade. Instead the shaft would be preferably retained by the cam blades When multiple cam blades are used, at least one of the blades can feature a shaft that is sufficient in length to produce a continuous length between blades.

In any embodiment or construction, the protrusions can be distributed at any point across the cam blade. The protrusions on the cam are sufficient to allow location of the integrated roller and roller type and/or plain bearings that will be used to set the effective profile of the cam. In this embodiment the roller type or plain bearings will be either removably or permanently attached to the roller, or in the plain bearing integrated at manufacture and of suitable friction reducing material. The suitable friction reducing material can be different to the bearing.

In one construction a carriage unit is located on at least one cam blade or between multiple blades preferably at any point over the surface of the cam blade. The carriage allows mounting of at least one shaft, roller and roller type and or plain bearings. The roller can be mounted such that it has free rotation and part of its circumference is above the carriage unit. The carriage can either be fixed or retain the ability to freely rotate.

Multiple roller assemblies and or roller carriages can be located across the cam blade or between at least two cam blades. The rollers are set relative to the axial rotation centre of the cam and preferably set the effective profile. A continuous or non continuous covering can be placed over at least one roller (preferably two) to form a track or covering.

The track or covering can be rigid or flexible and held moveably captive or non-captive with the confines of the cam and roller integrated body. The track or covering is located between the cam roller and the seat track such that, when the seat cam starts to rotate, the track or covering moves relative to the interaction of the cam rollers and movement of the seat.

The benefits to this system are fewer cam rollers 122, 126 are required for undulation free operation of the seat. Furthermore all cam rollers are able to produce relatively equal wear characteristics.

The carriage, continuous or non continuous shafts, rollers, bearings (roller type and or plain) and cam blade can be securely retained, preferably by interference fit between shafts and corresponding recesses or holes on each part. More traditional mechanical means can also be used via employment mechanical retention methods such as threaded members, threaded and locking members and members that exhibit a inner diameters below the outer diameter of the plain shaft and an outer diameter in excess of the plain shaft and used in relation to their radial force exertion for position and interactive stability and fitted in a groove or undercut to the plain shaft and or further members retained via a press fit, with the rollers having free rotation.

The roller assembly is positioned such that no undulation is caused to the seat during lifting or any other operation. A roller assembly can include at least one roller type or plain bearing, at least one roller and at least one shaft.

The thick section associated with the housing of the rollers can continue down the full length of the cam blade or stop at any point along its length. Alternatively, no thick section could be used.

The cam can be made from laminate or differing materials that combine properties of strength and friction reduction such as a metallic core surrounded by a polymer outer surface.

The roller can either rotate about the bearing relative to the shaft or the roller and bearing can rotate about the shaft.

The roller and/or the bearing, whether plain or roller type are set such that the outer surface or outer diameter is positioned above the cam and/or at least one cam blade.

The roller can be removably attached or permanently attached.

If a roller type of plain bearing is used, it can be removably attached or permanently attached to the cam and/or the cam blade.

The shaft can be removably attached or permanently attached to the cam and/or the cam blade.

The cam and cam blade can be removably attached or permanently attached to the cam and/or the cam blade.

The roller carriage can be removably attached or permanently attached to the cam and/or the cam blade.

The cam can be any shape or form, which is operative to produce the lift profile desired.

FIG. 8 also demonstrates the other parts of the system. An electric motor and reduction gear box 128 is preferably removably attached or permanently attached directly to a drive coupling 130. It is preferred that the motor and reduction gear box axe integrated; however, the units can be separate and joined via means of a shaft and retained via mechanical means such as a keyed shaft and key receiver and/or threaded, bonded or interference members.

In an alternate construction, no drive for the coupling is used. Instead, the motor directly connects removably or permanently to a gear that meshes with the gear before removably or permanently connecting to, and driving, the remaining mechanism.

In this construction the motor/drive coupling is preferably made via a keyed and grub screw fit. Preferably an alternatively connection can be made via use of a keyed and bonded fit. The coupling can take any misalignment out of the system and ensures that minimal non axial load is transmitted to either the lead screw 140 or the motor 128.

The drive coupling is removably attached and or permanently attached to the lead screw 140. The coupling and the lead screw are keyed to suit, with further retention of the joint via bonding agent and/or a grub screw.

Between the coupling and the integrated drive nut, it is preferred that the bearing support surface is located. It is preferred that the bearing support surface takes either roller type or plain bearings. In this embodiment plain bearings 132, 134 are used. This description also applies to the lead screw cam end support 140. The lead screw bearing surface as with any other lead screw surface can be coated preferably with friction reduction coatings to ensure smooth increased efficiency operation.

The lead screw is meshed with the integrated drive rack nut 136. The drive rack nut has a corresponding thread pitch to that of the lead screw. In this embodiment the pitch of the thread falls between 0.25 mm and 5 mm; however, other thread pitches can used dependent on the system requirements.

The integrated drive rack unit features a threaded section that meshes with the lead screw and the toothed rack section that integrates with the integrated cam gear. The nut 136 is preferably made in one complete section with little or no post route manufacturing process work being required.

It is preferable the thread section of the nut is made from a different material to that of the lead screw, with the threaded part of the nut being the threaded insert into the main body of the nut. The insert will be removably or permanently attached to the nut body such that it does not move relative to the main nut body while in operation.

Preferably the threaded nut insert is a different, preferably softer material to that of the lead screw. The nut main body and the toothed rack **136*a*** are able to be manufactured from the same material as lead screw. It is preferred this be either a metallic of polymer based material; however, other materials can also be used.

It is preferred that the drive rack nut is cast or injection moulded. The unit can be handed and/or universal. By this, it is meant that the rack section can be a feature on the nut main body both to right and/or to the left of the nut and thus fall either side, or at both sides, of the lead screw.

As can be observed from FIG. 7, is preferably located such that it remains in contact directly or indirectly with an internal surface of the seat portion 12. This stops the toothed rack 136*a* being able to become disassociated from the integrated cam drive gear. Furthermore the drive rack nut, and in particular the toothed rack section, is preferably either a circular, oval or square form; however, other forms can also be used.

The rack section of the drive rack nut 136 is connected to the cam drive gear via the integrated toothed section 136*a* which meshes with the cam drive gear. The cam is held in place preferably via an integral cam shaft on which roller type or integrated plain bearings are removably or permanently located; these will be discussed later in more detail.

The preferably integrated bearing also houses an integral retention surface to retain the at least one cam in a fixed position relative to other mechanism components whilst not limiting the rotation characteristics.

The mechanism is activated by the connection of the motor to the power source and preferably via an electronic control box. The control box issues an instruction from an external source of correct protocol to the motor in terms of speed and rotational direction. Integrated sensors can also influence the control box function and thus instruction set given to the motors.

The motor then drives the integrated gear box, which in turn drives the coupling 130 causing the coupling to rotate. The coupling rotation causes the lead screw to rotate, which in turn drives the drive nut which travels linearly across the lead screw. This motion drives the tooth rack section, which drives the integrated cam gear, which then rotates the cam around an axial pivot point to lift or lower the cam. Thus, the seat is raised and/or tilted in either direction.

The components of the raiser seat are preferably made from non-magnetic materials.

The seat 10 can rest on the interface between a projection at the end of the cam when the seat is in a lowered or horizontal position. The seat can also rest upon the seat unit and both provide a solid support to the seat when it is not being raised or lowered. A plan view showing only parts of the cam mechanism is depicted in FIG. 8.

A protrusion 124 is provided on the end of the cam, together with rollers 122, 126 which support the seat and allow relative movement of the contact point between the cam and the seat.

Figure 11:
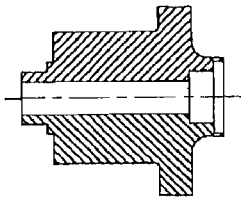
FIG. 11 depicts a cross section of the cam depicted in FIG. 9.

An example profile of the cam 104 is illustrated in FIG. 6. A plan view is shown in FIG. 9. This example profile includes recesses 148 into which a projection to engage with the at least one guide track on the seat can be mounted. FIG. 11 shows a cross section through one embodiment of the body of the cam.

Figure 9A:
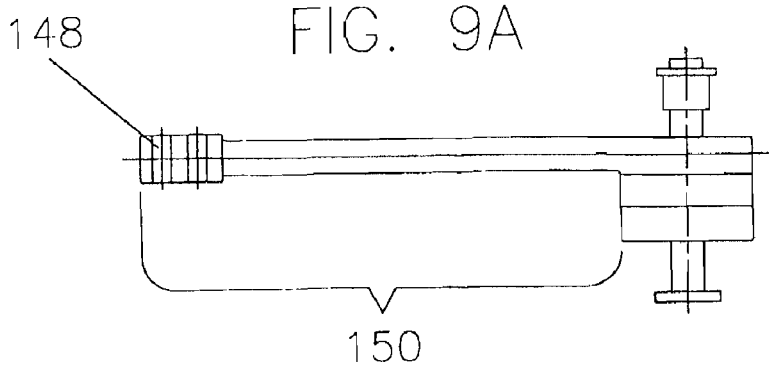
FIG. 9A depicts a plan view of the cam depicted in FIG. 8.
Figure 9B:
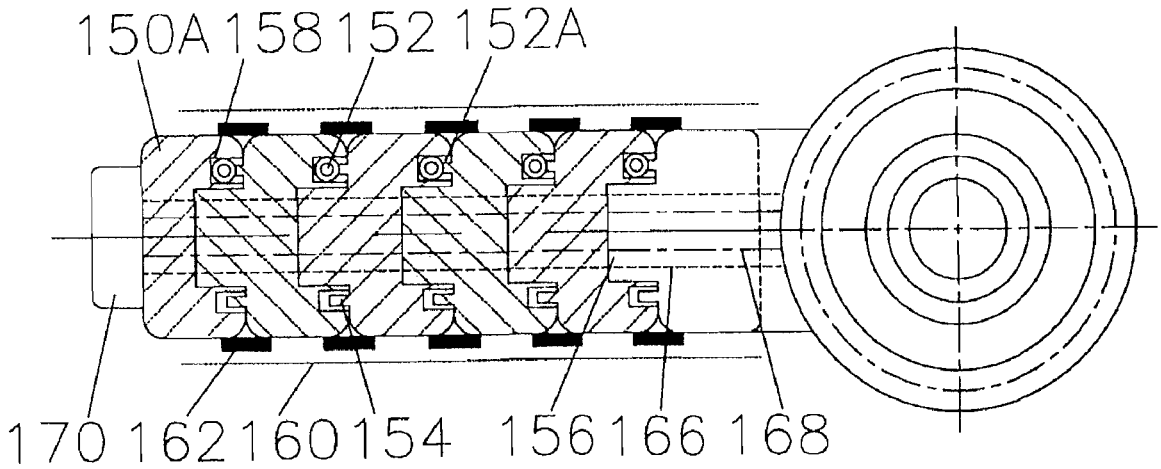
FIG. 9B depicts a dual axis sprung cam.
Figure 10:
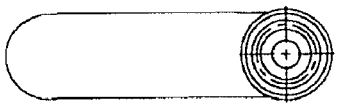
FIG. 10 is a side view of a cam profile for use with a first exemplary embodiment of the present invention.

As is shown in FIGS. 9, 10 and 11, a variety of features can be integrated with the cams. In particular the cam can include an integrated gear, at least one roller or plain bearing/bush, shaft and shaft locators. In alternate embodiments, some or all of the integrated features can be included. The cam can be manufactured from different materials at different locations from the one source route of manufacture. The cam can have a composite materials structure and/or laminate and/or a central core of a metallic material, with an out surface of a polymer based material. It is preferred that the surfaces such as the cam shaft and attachments 144 and 146 are integral from source manufacture and are of a material that can differ from the main cam material. They are preferably manufactured from a friction reducing material and all surfaces of the cam can be coated in a friction reducing coating.

The at least one cam has a removably and permanently attached integral drive gear that preferably is of a diameter between 5 mm and 200 mm pitch circle diameter and a metric modular teeth size of between 0.25 MOD and 6 MOD. It can be noted that all other meshing gears, including the toothed rack, will exhibit the same modulus and preferably be either anti-backlash or spur or helical format. Gears in the system can differ in format, however, all meshing gears will be the same format.

Figure 12J:
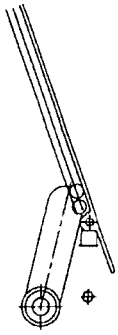

An example of the raising motion of the seat in this embodiment will now be described with reference to FIGS. 12*a* to 12*j*. FIG. 12*a* represents a lowered position of the seat and FIG. 12*j* represents a partially raised position of the at least one seat. The first sequence of the motion consists entirely of lift and is illustrated from FIGS. 12*a* to 12*d*. During this phase, the cam 104 rotates such that the rear of the seat which is supported on the cam 104 (or rollers 126, 127 or other members as has been previously described) rises at exactly the same rate as the actuator 112 is extended. This results in a pure lift of the seat.

The next stage of the procedure tilts the seat. The actuator 112 is preferably stopped automatically by the control unit but the cam 104 continues to rotate. This results in movement of the rear of the seat relative to the front which is held in position by its connection to the at least one actuator 122. Thus, as can be seen from FIGS. 12*e* to 12*j* the tilt of the seat becomes progressively greater. This combination of lift and tilt has been found to be particularly advantageous in assisting a person from a sitting to a standing position.

The lift profile can be altered by changing the profile of the cam, for example for one in which the seat is supported closer to the cam pivot point in the lower position, or one in which the pivot is located further from the cam pivot point in the lower position. Interchanging the cams can produce a wide range of differing move profiles depending on what is required. The precise lift profile will depend on the requirements of the user; the total overall time of the lifting cycle (the tilt and lift speed as well as other resultant movements) can also be adjusted allowing customisation of the mechanism to all user requirements.

From FIGS. 9*a* and 9B, in a further construction, the cam and/or cam blade 150 can rotate around the centre line at any place where a pivot is located. The cam/cam blade can have multiple rotation points and thus give the cam many degrees of freedom. The multiple or single rotating section allows the roller and/or roller assembly and or shaft assembly to be kept flush with the seat track at all times, even when the seat begins to roll and or pitch.

This dual rotating split axes cam has each section 150*a*, sprung loaded 152 or 162, or 160 (160 is a complete motion resilient coating) and pivots around its centreline 164 and protrusion 156; the protrusion or the cut out in which it sits can achieve the desired rotation via roller type and or plain bearings being insert onto or into the respect protrusion or cut out.

In this construction, the sections can be held in place via interference fit and or wires of other such structurally sound and or flexible means can retain the section; the "wires" 166 can run the whole section and be secured at both ends of the cam such that they provide the required wire tension and thus required flexibility. The wires are preferably metallic, polymer based and/or rubber based.

The other method is to employ a centre shaft, indicated by 168, with end stop section 170, preferable the shaft 168 is an integral part of the cam (although it can be a separate section) and section 170 is a separate section, or 170 and 168 can be integral and then later joined to the cam. It is also possible for the end section to be used to mount further non-rotation cam sections and thus form a two or multipart rigid/flexible cam. This is true of all flex solution as described. In the case of 168 the block closest to the integral gear does not rotate, this is the anchoring block. All fixings are as has been described i.e. interference fits, mechanical fits, threaded members (internal/external), press fittings, rivets (which can be applied in any embodiment) and any other method mentioned; all the sections can be place on the centre shaft, the shaft could be one long roller type or plain bearing and or coated with friction reducing materials such that each section is able to free rotate or each section/block can house a roller type or plain bearing or have integral bearing material on its inner bore surface.

The roller and/or roller assembly and/or shaft assembly/protrusion/connection and/or carriage unit members be attached to the sections 150*a* as has previously been described and thus can take any profile that allows the unit to effective remain in contact with the seat track through all aspects of the seat displacement.

All the roller and/or roller assembly and or shaft assembly, can be mounted in either the at least one cam and/or cam blade and/or seat and/or carriage unit with the use of spring loaded assemblies either those mounted internally via cavities/slots and pegs 152*a*, 152 and 154 and/or those mounted externally such as 162 which are can be applied as singular flexible strips and/or multiple and at any point and or combination over each joint and or a complete flexible sheath 160 that allows all the required connections i.e. the at least one roller and/or roller assembly and/or shaft assembly/protrusion/connection and/or carriage unit without exception.

In a further construction the drive system can feature alternative gears and these can include worm drives, spur, helical, bevel, anti-backlash type gears can be present and or combinations where possible.

In all constructions, the roller and/or roller assembly and or shaft assembly can preferably feature convex or concave (positive or negative bowing and or camber) and raised sections or any other shape/profile in between and thus are able to cope with any contact scenario.

Figure 13A:
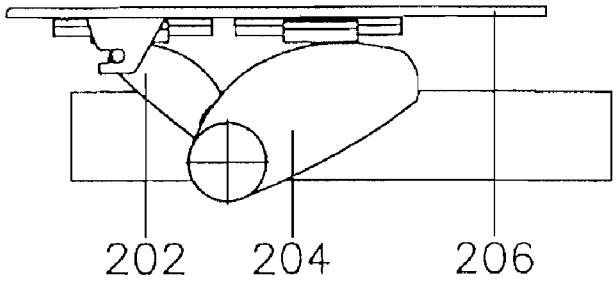
FIGS. 13A to 13C depict a second exemplary embodiment of a lifting sequence.
Figure 13B:
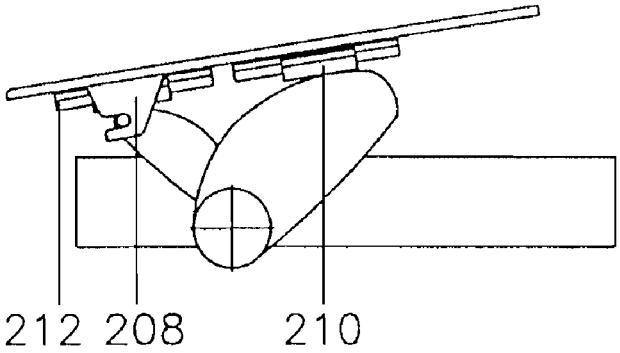
Figure 13C:
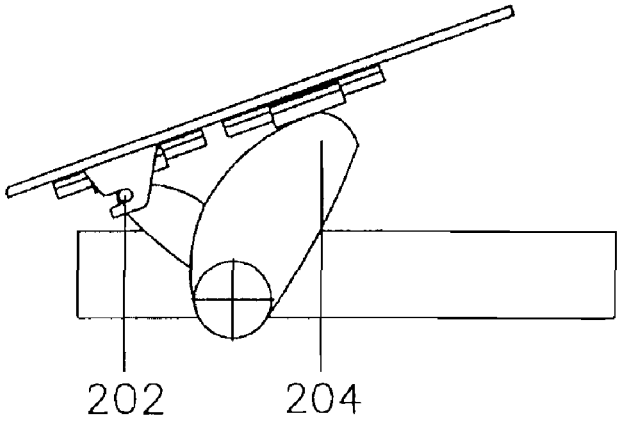

A second embodiment of the lifting mechanism is depicted in FIGS. 13A, 13B and 13C. In this embodiment two pairs of cams 202, 204 (which exhibit all the same characteristics and features as 104) control the lift and tilt of the seat 206 (which exhibits all the same features as 10). The similarities of the systems in terms of mechanisms are also apparent from FIGS. 14A, 14B, 15A and 15B.

The pair of cams 202 towards the front of the seat is pivotally connected to a projection 208 formed on the seat 206 at certain predetermined points in the lifting cycle. The pair of cams 204 supports the rear of the seat directly by a slider, track or roller mechanism 210 as previously described in other embodiments. A further slider, track or roller mechanism 212 as previously described in other embodiments, supports the front portion of the seat 206, above the pivotal connection. This allows the contact position of the seat 206 and the cam 202 to move, while still entering, existing and maintaining the seated location with the pivotal connection.

The pivotal connection via projection 208 is achieved by the means of a recess which is open at one end. The positioning of the recess is such that the seat is has a pivot point on which the rear cams can act and thus tilt the seat.

The front and rear cams exhibit all the same characteristics as discussed above in relation to FIGS. 2-12J. This quad cam embodiment is a true "floating" seat cam mechanism. It is both safe in use and retains the seat on the cam with little or no mechanical losses.

The cams have the same roller assemblies 122, 126, the same removably attached and or permanent gear 106. Furthermore the connecting member 124 is also present on all of the cams. With relation to the seat all the main features are present, this includes the at least two seat guide track 800 and 804 and seat guide track 810. The component referenced as 208 acts in similar ways to 802, with the protrusion 202 being a further embodiment of the parameters of the connecting member associated with 124. All these have previously been described in the text and with their associated components and members are applicable to this embodiment.

In a lifting sequence, the front cams rotate in the opposite direction to those of the rear units and thus they advance towards each other. As the front cams rotate with the aid of roller assemblies and slides (as previously described), at a predetermined point they interact with a pivotal connection. The movement up to that point is preferably pure vertical lift. However combinations of movement can be introduced to alter the seat displacement and the point at which the cam engages the with the pivotal connection.

The seat 206 preferably rests on the cam rollers 122 and 126 as previously discussed. Each of the cams front and rear preferably engages with its own seat guide track. However, the seat guide tracks can be adapted to run a length suitable for the requirements of each side, this allows one front cam and one rear cam to use the same guide track.

Each of the four cams has the connection member 124 in the same manner as has previously been described. The seat is connected to all four cams. As before, the connections do not restrict movement of the seat in relation to the cam movements. They only act to retain the seat against accidental disconnection from the cams.

In an alternate construction, at least one protrusion/connection member is used to interface with at least one set of guide tracks. In this construction it is preferred that there are two guide tracks per cam. (The same can be achieved with at least one guide track.) However, it could also be each side, each having a different or the same outer profile and each having a different entry interval for the protrusions from each cam. The guide tracks can also feature grooves as well as, or instead of open and/or closed channel guide tracks. The connecting member can vary in length, dynamically or set at certain distances away from the cam face to suit interaction with open or closed channels. The channels are of no fixed profile or depth or width, as are the connecting member. However, it is preferred that the profile is straight or taper-sided, with the connecting member and open/closed channel profiles preferably having the inverse to the shape of the other.

As the cams start to operate and the seat begins to lift in a vertical manner; connecting members now start to interact at different set timings and intervals with the correct open or closed channels, on the seat. The width of open or closed channel and the dimensions of the connecting members are such that no contact occurs unless a force is placed on the seat such that it is in danger of accidentally being disconnected from the cams or relative horizontal movement, in particular a movement that would potentially see the seat dislodged from any one of the cams.

The design of these extra open or closed channels is such that they preferably only operate within a first vertical section of the lift until the front cams tilt connection member 202 has engaged within the tilt member receiver 208. After which point the system operates exactly as has previously been disclosed i.e. the front cams control the pivot point of the tilt and can move in either direction. In effect this means the seat gains an extra two axes of movement: the whole seat can actively travel forwards and backwards and the just the front can actively travel forwards and backwards. Furthermore, these movements are achieved in a safe manner with little efficiency losses due seat retention mechanisms.

The channels can be varied, as can the position of the connecting member with which they interact. The extra guides and/or open and/or closed channels can interact with either the rear set of cams 204 or the front set of cams 202 or both.

Thus, the system is widely variable, very smooth, energy efficient, and able to be adapted to any environment or user constraint with little energy wastage on counter loading of the seat.

The slides 210, 212 with which the cams 202, 204 operate in exactly the same way as has previously been described in other embodiments, noting that 210 and 212 and the same as has been described for 810 and all its interactions. The cams 202,204 have exactly the same described features and make up as 104, as described above.

The at least one carriage, continuous or non continuous shafts, rollers, bearings (roller type and/or plain) and cam blade can be securely retained, preferably by interference fit between shafts and corresponding recesses or holes on each part and or more traditional mechanical means via employment mechanical retention methods such as threaded members, threaded and locking members and members that exhibit a inner diameters below the outer diameter of the plain shaft and an outer diameter in excess of the plain shaft and used in relation to their radial force exertion for position and interactive stability and fitted in a groove or undercut to the plain shaft and or further members retained via a press fit, with the rollers having free rotation, can all be used with the quad cam system described above (the second embodiment).

Figure 14A:
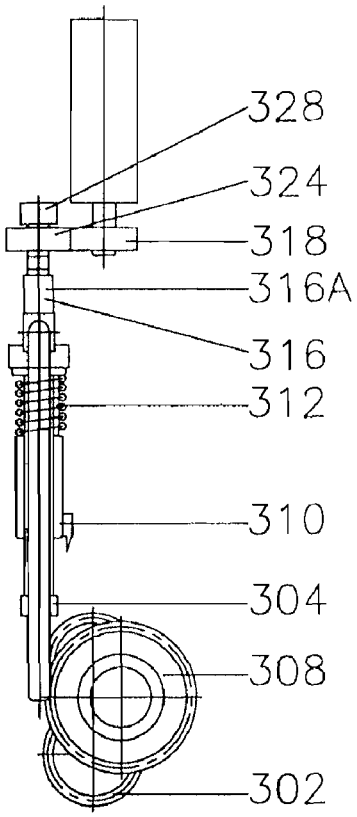
FIGS. 14A, 14B and 14C respectively depict a side view and plan view of a cam movement mechanism and an overall plan view according to a third exemplary embodiment.
Figure 14B:
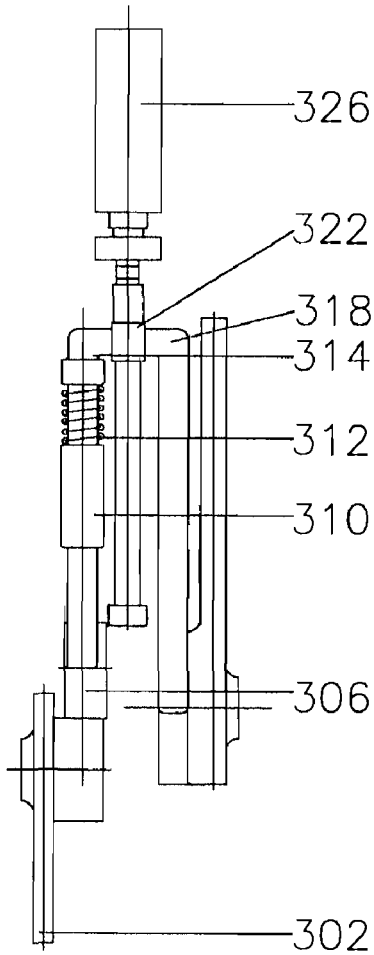

A third embodiment is depicted in FIGS. 14A and 14B. FIG. 14A shows a side view and FIG. 14B shows a plan view. This version uses a single motor to power one pair of cams 302 and 308. Cams 302 are located towards the front and cams 308 are located towards the rear, with each full lift mechanism comprising two mechanism sets i.e. a front and a rear cam drive by one motor at the left side of aperture 102 and the same at the right side of aperture 102.

This embodiment uses a split rack/shaft mechanism comprising the main components of the direction retainer gear 306, the sprung gear retainer 310, the mechanical or natural spring 312, the dual arm drive rack nut 322 with split rack/shaft section 314/318, the lead screw 316 and the motor 326. These main components with some sub components (described in more detail later) allow the mechanism to drive two cams with different stroke lengths from a single drive source. The drive rack nut in this embodiment has preferably two integral drive racks located at each side of the nut, as can be observed from FIGS. 14A and 14B.

Figure 14C:
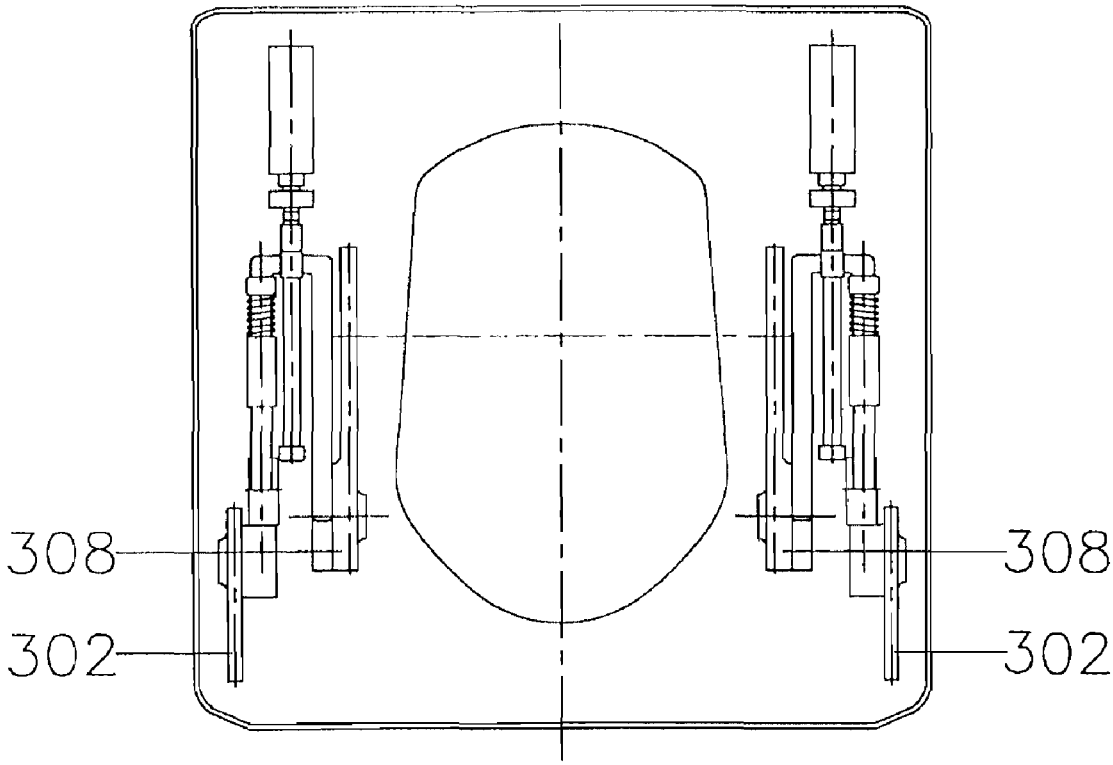

The cams in this embodiment have the same features and characteristics as those discussed in 104, 202 and 204. In FIG. 14A one side of the mechanism is depicted, the other mechanism is exactly the same, yet mirrored around the seat centre line with the cams and subsequent components and members located on corresponding i.e. opposite sides to that shown. The function of each side is exactly the same and all the same components and members are used in the same way; as is better shown in FIG. 14C.

The cams as described in described above in relation FIG. 13A-13C, work in opposite directions and thus to achieve this via one motor, only one can be directly driven by the drive rack nut 322. In this case the large rear cam is directly driven. The small front cam is driven via a drive gear 306. As has previously been described, the cams have an integrated drive gear, the large cam gear meshing with the drive rack nut 322 and in particular the toothed drive rack section 318, whilst the small front cam integrated gear meshing with the secondary gear 306 which in turn meshes with the drive rack nut 322 and subsequent drive rack or split rack/shaft section 314.

The components aft of the cams will now be described, detail of each can be transposed. Firstly, cams with integrated gears have been well described above. However, cam and drive gear location has not been discussed. When a drive gear is used in the lifting mechanism the gear is placed in an offset position to avoid clashes with the drive rack nut and drive rack section 314/318 and 322 respectively and any of its components, the offset position being described as vertical difference in horizontal centre lines between the integrated cam drive gear and the drive gear itself.

This format is an important consideration as it means that the effective horizontal distance used to mesh the gears is reduced. Preferably the smaller front cam gears are smaller than the large rear cam gear, thus the effective transposed combined depth is no greater than the large singular integrated rear cam drive; thus a compact system can be produced.

The drive rack nut 322 will now be described, this has also been well described in previous embodiments and preferably consists of several integrated parts, a threaded insert of the same thread as the lead screw thread with which it meshes with the two drive racks, located either side of main nut body.

The drive rack sections 314 and 318 are preferably an integrated feature stemming from route source manufacturing. The location of the rack drives can be placed in any position around the circumference of the main body relative to the lead screw. This is true in all application and can be observed via FIG. 7A and FIG. 14A. From the preferred embodiment the rack 136/136*a* is positioned above the lead screw whereas in FIG. 14A, the rack is located at the side and at the same vertical level as the lead screw; this is true for the racks located at either side i.e. for front and rear cam/drive gear meshing.

Each of the arms of the rack drive can have different main parameters. Firstly the length and overall base shape and or form can be different. For example, one rack can exhibit a round base form, whilst the other rack can exhibit an oval or square profile. Further, each can exhibit different gear tooth patterns/configuration and can either have teeth formed with original source manufacture or post source manufacturing cut teeth and the racks can differ dimensionally.

The main difference between the drive racks sections is that of the addition of the sprung gear retainer 310 and natural or mechanical spring 312. The retainer is used to achieve the main usage parameters of the system and works to engage with the drive gear 306 to retain the small front cam in a set position. In this embodiment, the drive rack section 314 exhibits a raised section on which a mechanical spring is removably or permanently attached. Other methods of both exerting and/or resisting the travel of the retainer along its given axis may be used, such as resilient means including elastomers, rubbers or polymer based materials.

The sprung gear retainer is located on the shaft, preferably this unit is made in one piece, although the unit can be made from a number of components which are removably or permanently attached i.e. welding/bonding agent or via inference fits and or mechanical retention means such as threaded members.

The unit can incorporate roller type or plain bearings and/or linear or rotational slides within its bore which will contact directly to the surface of the drive rack. The bearings and/or slides can be coated with further friction reducing material and can be removably or permanently attached. The action of the spring is to exert a force on the spring retainer which advances the retainer towards the drive gear. An increase in the shaft diameter retains the sprung gear retainer in a set forward position. The set position can alter the small front cam stroke.

This alternation and therefore the original set point can be accomplished in many ways. The preferred option is an increased section integral to the drive rack and/or split drive rack section at route source of manufacture. This is placed at the front most point possible and then for every subsequent alteration a separate member of raised section, equal or not equal to the outer diameter of the integral raised section, is removably or permanently attached to the drive rack and/or split drive rack section 314, between the sprung gear retainer and the integral raised section and thus alters the effective stroke distance of the sprung gear retainer and the point at which it interacts with the drive gear.

Manufacture of the raised section can be combinations or individually administrated processes, preferably these include the application of continuous members via interference fits, continuous members with significantly smaller inner diameters (in comparison to the drive rack nut/drive rack split/shaft nut) and thus implying that the drive rack can be manufactured in a number of separate sections and non-continuous raised sections with mechanical fit and closure and all preferably with or without threaded members, welding, keyed sections, interference or pressure/press type jointing and/or bonding to hold the various/relative members in the desired location or manner.

In an alternate construction the raised section can be located post route source of manufacturing by a number of different processes. The preferred processes for the raised section location can be combinations or individually administered processes and are centred on continuous inference fits, undersized raised section inner diameter with or without sprung members and with or without drive rack undercuts, non continuous raised sections with mechanical fit and closure all with or without threaded members.

It is preferred that the raised section is removably attached and thus if the effective stroke distance of the sprung gear retainer requires alternation, the work can be completed cost effectively via the use of standard continuous differing thickness annular ratio members.

In the case of the drive section 318, this is an integral part of the main drive nut 322. The moulded and/or cut gear toothed section can be the full length or a partial length of the rack. The gear teeth characteristics are preferably the same as the other system components, although if required the each cam and integrated gear and thus the drive rack, can have the same teeth characteristics to all other gear toothed members, for example one the other cam gear and drive rack sets.

Both drive racks are removably or permanently attached to the main body of the drive nut, which houses a removably or permanently attached or integrated threaded insert member of a different material. The insert member allows location onto the lead screw via meshing of threads as has previously been described in other embodiments.

The lead screw can be removably attached or permanently held in position preferably by roller type of plain bearings/bushes, the bushes/bearings preferably being located on the lead screw in one of three places, 304, 316*a* and 328. The surfaces at these points are preferably coated in a friction reducing material substance and as in all embodiments and constructions are of a suitable surface finish for the prescribed usage.

At least one gear is located on the lead screw. The gear can be permanently or removably attached to the drive rack and/or split drive rack section preferably via mechanical means such as plain or expandable pins and or circlips, both with interference fits and both can be bonded. Although it is also preferred that keys and threaded members can be utilised for gear retention purposes.

The last part of the system is the motor and gear arrangement. The arrangement of the motor with integral gear box connected to a drive coupling has been described in relation to 124 and 130 from FIG. 8 and the parameters of a keyed and mechanical connection are directly transferable to this application as are the methods described for gear attachment to the lead screw above, for example keyed and pinned, with expandable or plain pin and or cirlips, both with interference fits and both can be bonded. Both the motors 326, 320 are held in position via attachment to the seat unit 12.

The system is operated by a control unit that interprets inputs from a number of sources such as sensors and operator/user instructions. The control unit allows power from a power source to flow to the motors in a manner that controls the speed of rotation and power available. The rotation of the motor drives the gear 320, which in turn is meshed with and drives the gear 324. This gear then drives the lead screw which in turn drives the drive rack nut as a result of the meshed relationship and as a result of the application of power to the motor.

As the drive rack nut advances, the split drive rack/shafts advance and cause either the large cam gear 318 to rotate or the drive gear 306 to rotate. The large cam gear 318 results in large cam rotation whilst the drive gear 306 results in the rotation of cam 302.

The spring retainer 310 is preset at certain distances by a stop member which is on or art of the split drive rack/shaft on which the retainer is located, as has previously been described. As the rack shaft advances, the drive rack section 314 meshes with the gear either integral to the cam or, as in this embodiment, meshed with the cam drive gear 306 to provide a difference in rotation between the front and rear cams from the same drive.

As the rack continues to advance, the sprung retainer section eventually meshes with the drive gear 306 and thus holds it in position; in a different embodiment the drive retainer can be applied directly to the integrated cam gear. The slide part continues to advance through the sprung retainer. This allows the mechanism of two cams with different stroke and rotational parameters and characteristics to be driven from the same motor.

The sprung retainer 308 is pre-set at certain distances by a stop member which is on or part of the split drive rack/shaft on which the retainer is located as has previously been described. As the rack/shaft advances, the rack section meshes with a gear integral to front cam 302 and provides rotation to cam 302. Thus, this embodiment allows a single drive source to drive two cams, with each cam being required to rotate by a different amount.

Figure 15A:
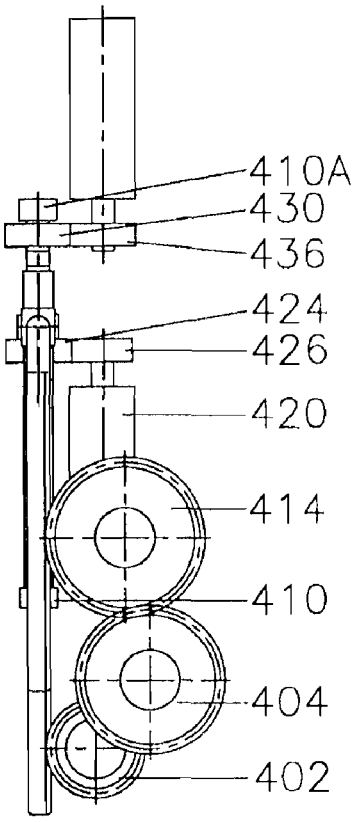
FIGS. 15A, 15B and 15C respectively depict a side view and plan view of a cam movement mechanism and an overall plan view according to a fourth exemplary embodiment.
Figure 15B:
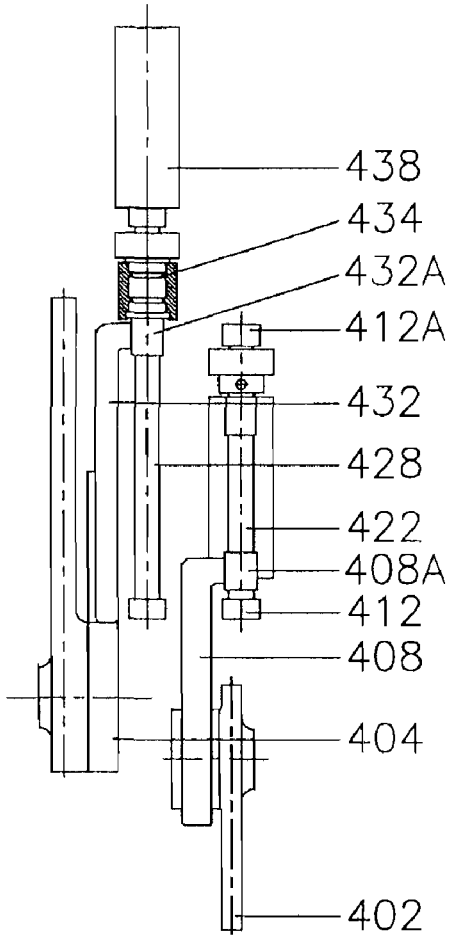
Figure 15C:
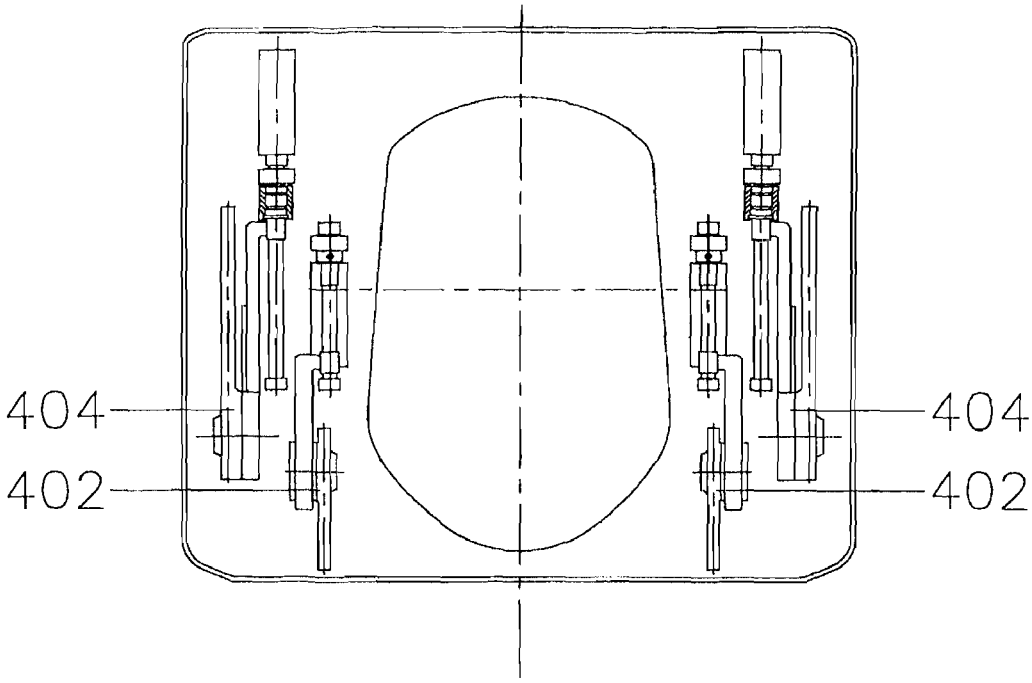

A fourth embodiment is depicted in FIGS. 15A, 15B and 15C. This embodiment incorporates two separate drive systems for a front cam 402 and a rear cam 404. The system is such that the all aspects of all other embodiments as described in the text can be utilised for all components, for example the cams referenced 402 and 404 and have all the same features as those of 104, 302 and 308 and or the references to any other embodiment for the lead screws 140 and 316.

This embodiment differs from the other embodiments by the system layout and the dual feature usage of the integrated cam gear 404 and drive gear 414. The first difference to the previously described systems is the individual cam drives. This means that each lifting cam has an individual motor for its power source. This yields large flexibility in the system meaning that each of the cams can be precisely controlled and the seat can then be tilted and rotated side to side; for example, "pitch and roll" where tilt is equal to pitch and roll is equal to side to side movement. This can assist compensate or "shim" certain users and particularly stroke victims. This pitch and roll can be achieved by all embodiments and constructions.

One side of the lift system is depicted. As with the embodiment of FIGS. 14A and 14B preferably two sets are required for a complete lifting system placed either side of the aperture 102. Thus the one set can be mirrored to gain an impression of the other set, the large cam always remaining on the outside edge, as can be seen in FIG. 15C.

Discussing each sub system in turn, starting with the small front cam mechanism, a cam with integrated gear 402 is provided. An integrated drive rack 408 and drive rack nut 408*a*, a lead screw preferably supported at 412, 412*a*, a lead screw 422, two drive gears 424, 426 and finally a motor 420.

The lead screw is held in position by the seat unit 12 and uses roller type or plain bearings removably or permanently attached to rotate with minimum friction. The cam drive rear is meshed to the drive rack, this is integrated with the drive rack nut and the two components are removably or permanently attached either via the route source manufacturing i.e. casting or via a post process preferably via welding and or mechanical/threaded fixings and interference fits.

Held captive within the drive rack nut is a threaded insert, the insert meshes with the lead screw thread, both preferably being the same pitch and thread designation. The insert is removably or permanently held captive within the drive rack main body. The gear on the end of the lead screw is removably or permanently attached via mechanical and/or other means, preferably via a keyed and/or expandable or not expandable pin and/or a threaded member.

The leadscrew gear is meshed with the gear 426 which is removably or permanently attached to the integrated motor and gear box shaft via mechanical and/or other means, preferably via a keyed and/or expandable or not expandable pin and or a threaded member.

The large rear cam mechanism has a cam with integrated gear 402, an cam drive gear, 414, an integrated drive rack 432 and drive rack nut 432*a*, a lead screw preferably supported at 410 and 410*a*, a lead screw 428, two drive gears 430 and 436 and finally a motor 438 and a special rigid cased linear and rotational plain bearing 434.

The lead screw is held in position by the seat portion 12 and uses roller type or plain bearings removably or permanently attached to rotate with minimum friction. The cam drive rear is meshed to the drive rack, this is integrated with the drive rack nut and the two components are removably or permanently attached either via the route source manufacturing i.e. casting or via a post process preferably via welding and or mechanical/threaded fixings and interference fits.

Held captive within the drive rack nut is a threaded insert, the insert meshes with the lead screw thread, both preferably being the same pitch and thread designation. The insert is removably or permanently held captive within the drive rack main body. The gear on the end of the lead screw is removably or permanently attached via mechanical and/or other means, preferably via a keyed and/or expandable or not expandable pin and/or a threaded member.

The leadscrew gear is meshed with the gear 436 which is removably or permanently attached to the integrated motor and gear box shaft via mechanical and/or other means, preferably via a keyed and/or expandable or not expandable pin and/or a threaded member.

An additional large gear 414 is provided to drive the rear cam 404. The cam is driven through this gear 414, which allows the speed and torque characteristics of the rear cam 404 to be determined by the choice of the large gear 414. The centre line of the large gear 414 can be above or below that of the gear attached to cam 404. The size of the large gear can give a speed or effective torque alteration within the system. Choice of an appropriate large gear size can therefore adapt this embodiment to a number of drive configurations.

The large gear has a further purpose in that it is able to reduce the effective stroke length of the drive rack and thus enable a greater number of packaging alternatives for the mechanism. The stroke length also depicts the possible pitch of thread on the leadscrews and thus the size of the gear can affect the whole system. This includes the speed of the motor and through to motor selection through all other aspects including the motor gear box, gear sizes and ultimately cam size. The larger gear and the location of the gear will furnish the drive rack with a reduced or increased stroke for the same actual rotation of a cam; thus the rack and the gears can be matched to suit any pitch of lead screw.

The large gear of this embodiment can be applied to any of the other embodiments if desired. Likewise, an additional gear could also be used to drive the front cam 402.

The rack drive can be manufactured of a flexible material and this can be applied to any other embodiment if desired.

The motor 438 and 420 power the respective the systems as described and the action results in rotation of the cams, typically through the series of meshed interactions. It is important to note that to achieve the reverse rotation on one cam, the drive rack nut is located at the furthest point of the lead screw with the motor running in reverse direction compared to previously described embodiments and in this embodiment compared to the other motor. It is also important to note that the motor for the small cam has been orientated differently to other referenced systems; this orientation as with any other orientation can be applied to other systems and embodiments if desired.

The roller assembly is positioned such that no undulation is caused to the seat during lifting or any other operation. A roller assembly can include at least one roller type or plain bearing, at least one roller and at least one shaft.

The thick section associated with housing the rollers can be continued down the full length of the cam blade, or stop at any point along its length, or no such thick section housing could be required.

The cam can be made from laminate or differing materials that combine properties of strength and friction reduction such as a metallic core surrounded by a polymer based outer surface.

In a further construction/embodiment the carriage unit is split into two sections, one section is a free rotation section and the other is permanently and/or removably fixed to at least one cam and/or cam blade and is not able to be rotated. The fixed section has a continuous/non continuous raised material section that protrudes from the base of the section to form a bowl like shape. The base can be concave of convex and the raised sections can be perpendicular to the base, although the angle between the base and the raised section can increase and decrease. For explanation, the walls can point outwards or inwards and the base has a protrusion in the centre that is preferably circular and can be hollow or solid.

The mating unit is also as per that of the fixed section as described, it features continuous/non continuous raised material section that protrudes from the base of the section to form a bowl like shape. The base can be concave or convex and the raised sections can be perpendicular to the base, although the angle between the base and the raised section can increase and decrease. For explanation, the walls can point outwards or inwards and the base has a protrusion in the centre that is preferably circular and can be hollow or solid and is free to rotate.

The free rotation section or mating section either assembles to the fixed section on the inside or the outside. In the case of the at least one section fitting on the inside, the free section will carry the at least one roller/roller assembly and/or shaft assembly on the remaining external surface, this will be the external part of the base. In the case of fitting of the free rotation section, the at least one roller/roller assembly and/or shaft assembly are fitted to the raised section external surface.

The assembly then takes the usual seat carriage unit emphasis in that the multiple or single roller/roller assemblies and or shaft assemblies set relative to the axial rotation centre of the at least one cam and thus set the effective profile of the at least one cam and seat displacement. A track or covering can be placed over the at least one roller/roller assemblies and or shaft assemblies to form a track or covering that can be rigid or flexible, continuous and or non-continuous and held moveably captive or non-captive with the confines of the carriage unit can be fitted in this configuration.

The protrusions in each section can carry bearings to allow the free section to rotate, the bearings can be roller type and/or plain bearing/bushes. The bearings are attach permanently or removably via interference fit as are the two sections of the carriage units via the solid and/or hollow protrusions.

At least one track/conveyor on the at least one carriage unit allows the effective movement of the at least one cam against the seat with minimal friction and as little resultant undulation as possible; the track allowing a greater pitch (defined as the distance between relative members centres) between the at least one roller and/or roller assembly and/or shaft assembly.

In a further embodiment the carriage unit can be mounted in a sprung fashion, using mechanical and/or polymer based and/or rubber materials and design solutions, it is also possible to mount all the at least one roller/roller assembly and/or shaft assembly in a sprung fashion using similar means and this is applicable to all embodiments and constructions.

In all embodiments the motor 128, 326, 412 is preferred to feature an integral reduction gear box to reduce the final rotational speed of the motor and increase permissible torque output from the motor device.

In all embodiments and or constructions, all referenced grooves and open and/or closed channels are of no fixed profile or depth or width; however, it is preferred that the profile be straight or taper sided and any interacting member preferably having the inverse to the shape/format of the groove and open and/or closed channel.

In all embodiments the roller can either rotate about the bearing relative to the shaft or the roller and bearing can rotate about the shaft.

In all embodiments the roller and/or the bearing, whether plain or roller type can be set such that the outer surface or outer diameter are positioned above the cam and or cam blade.

In all embodiments the roller, can be removably attached or permanently attached.

In all embodiments the roller type of plain bearing can be removably attached or permanently attached to the cam and/or the cam blade.

In all embodiments the shaft can be removably attached or permanently attached to the cam and or the cam blade.

In all embodiments the cam and cam blade can be removably attached or permanently attached to the cam blade or the cam, respectively.

In all embodiments the roller carriage can be removably attached or permanently attached to the cam and or the cam blade.

In all embodiments the cam can be any shape or form depending on the desired lift characteristics.

Figure 16:
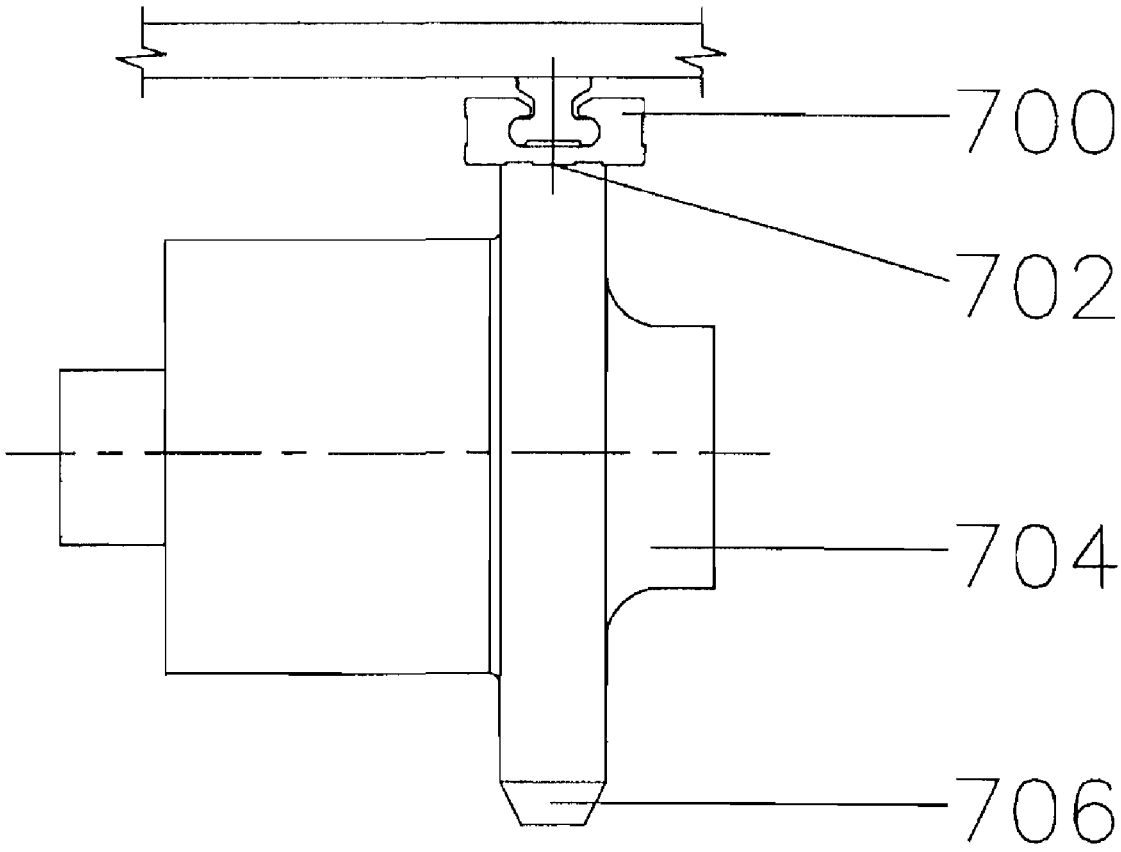
FIG. 16 depicts a cam and track mechanism of a fifth exemplary embodiment.

A fifth embodiment is depicted in FIG. 16. In this embodiment the cam 704 interfaces with the seat by a slider or track system 700 and is as described above in relation to 810. 702 and 706 are to highlight the different profiles possible for any cam edge. Preferably the cam edges are tapered 706. In all cases they are made to suit the seat track interface for smooth non-undulating operation that is safe in use and of the correct function. They are also chosen to reduce frictional loads.

A sixth embodiment of the present invention is depicted in FIGS. 17 to 20. This uses a mono-chassis lifting pod. The mono-chassis pod is unique in medical applications; the pod is the main structural part of any device that it is used within. The main devices where the pod would be used are, dynamic commodes, static commodes, wheelchairs, transfer chairs etc, all the uses representing the second unique feature i.e. multi-functionality; see FIG. 17.

Figures 17, 18, 19, 20:
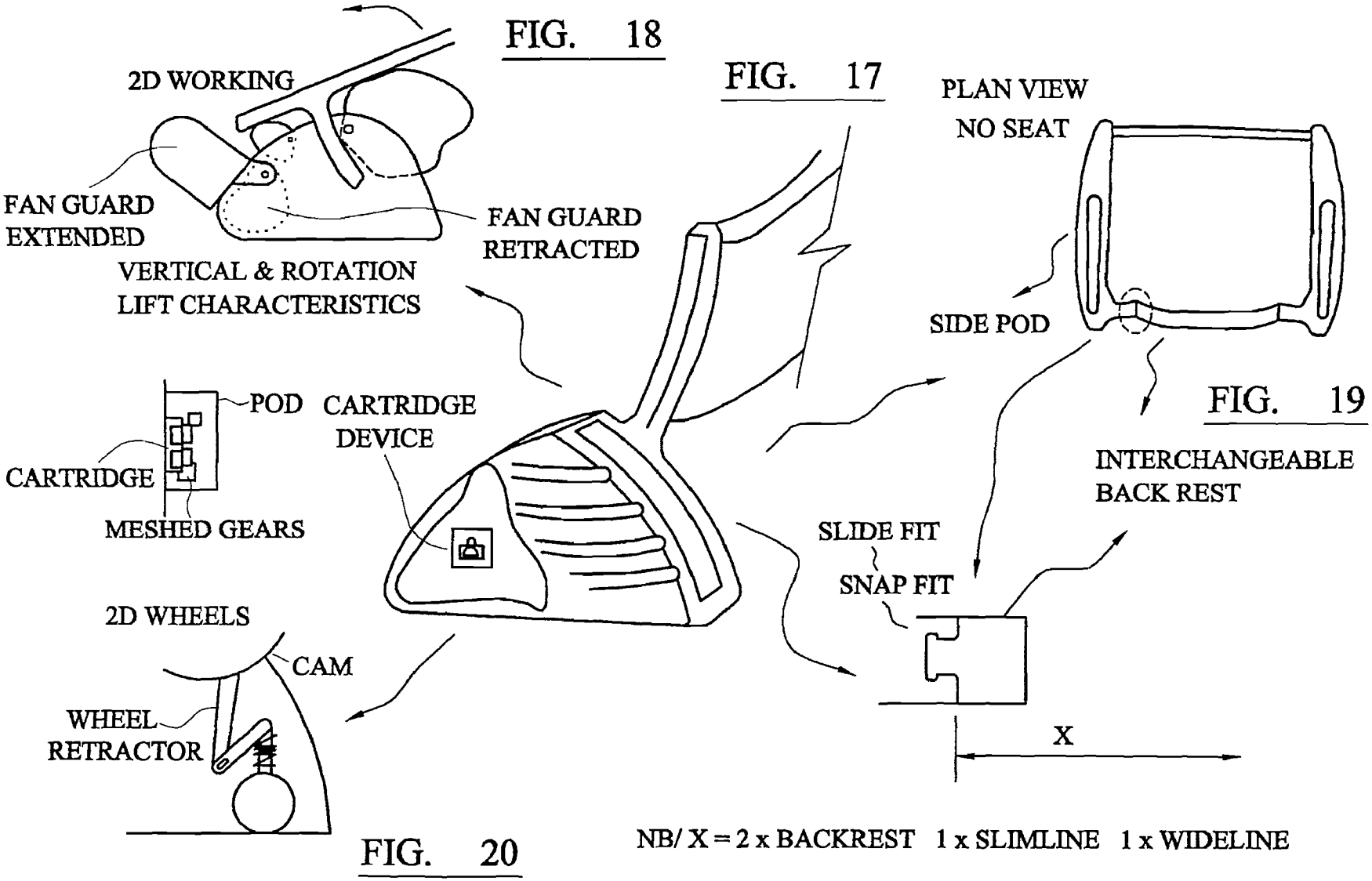
FIG. 17 depicts one side pod assembly of a sixth exemplary embodiment of the present invention.
FIG. 18 depicts a cam lift mechanism for use in the embodiment of FIG. 17.
FIG. 19 depicts a front view of the top of an embodiment using the side pod assembly of FIG. 17.
FIG. 20 illustrates the retractable wheel mechanism in for use in the embodiment of FIG. 19.

The pod can house a motor and cam lifting mechanism in order that lift can be applied to a seat if required and if incorporated with another side pod and joined via a backrest; see FIG. 18.

The pod also includes an integral backrest support, a feature that has never previously been observed in the medical sector.

An internal braking mechanism is provided, a feature of which is that the pod is designed such that the wheels can be retracted—this is completed via a sprung or other such mechanism; see FIG. 20.

The embodiment has the ability to use a simple "snap" or sliding fit for the actual backrest; noting the pod is always used in two halves, each half being restrained by the association with the backrest.

The pod of this embodiment is also able to take a special medical power and motion transmission cartridge; the cartridge is located in the device and can provide motion of the various mechanisms i.e. the cam lift systems.

A seat can be incorporated into the system as per FIG. 17 if required—the cam lift (FIG. 18) can be used to raise the seat.

In an alternate embodiment, the seat is supported at its front by a pair of cams instead of the lift actuators of the first embodiment.

In a further alternate embodiment, other driving mechanisms are used to drive the rack and the cam. This can include additional gears to allow rotation of the cam in either direction without requiring that the rotation direction of the electric motor is altered.

In another alternate embodiment, different lift patterns are used. These include: a combination of lift and tilt simultaneously; tilting the seat alone and simply raising the seat.

In another alternate embodiment, the seat frame does not incorporate a backrest.

In an alternate embodiment, friction reducing coating or materials are used.

In an alternate embodiment, the seat has integral armrests.

In an alternate embodiment, the frame includes push/pull/location handles located in selected areas.

In an alternate embodiment, connection points are provided on the frame.

In an alternate embodiment, the frame comprises removably attached components.

In an alternate embodiment, footrests are incorporated into the frame.

In an alternate embodiment, the frame houses electronic components.

In an alternative embodiment a disposable or permanent cover in part or whole can be placed over the seat, seat frame, backrest and seat portion.

In an alternative embodiment a removably attached soils reciprocal can be permanently or removable attached to the seat portion and or the disposable or permanent cover.

In still further alternate embodiments, a large variety of alternative ways of realising the invention can be achieved. In these embodiments, belt drives, v belt drives, meshed gears, vertical lift, pivot bars, shaft, gears, drive mechanisms, motion exciters, seals magnets, solenoids, sliders, grooves, pins and grooves, gear teeth, belts, toothed belts, v, belts, bearings, vertical/rotation/vertical/lift/tilt/linear/cam drive/motion exciters, sprockets or power/motion transmitter transfer components, or chains are utilised.

All the above embodiments are particularly well suited to use in medical transfer chairs, other mobility applications, and commodes. It will be appreciated that numerous other minor modifications will suggest themselves to the person skilled in the art. This description should not be seen as limiting the scope of the invention, which is defined by the appended claims.

The invention claimed is:

1. A riser seat for assisting a person from a sitting position to a standing position, comprising:

seat frame;

a seat comprising upper and lower surfaces, the seat being movable between first and second positions; and a cam arm pivotably mounted with respect to the seat frame and having a camming surface movably engaged with the seat and the cam arm moves the seat along a movement profile between the first and second positions, wherein the camming surface defines the movement profile and the camming surface moves tangentially relative to the lower surface of the seat to move the seat between the first and second positions.

2. The riser seat of claim 1 wherein the camming surface is slidably engaged with the lower surface of the seat.

3. The riser seat of claim 1 wherein the cam arm is coupled to the seat frame at a pivot point, and the cam arm pivots about the pivot point.

4. The riser seat of claim 3 further comprising:

a gear coupled to the cam arm and coaxial with the pivot point; and a rack in meshed engagement with the gear such that translation of the rack results in the cam arm pivoting about the pivot point.

5. The riser seat of claim 1 further comprising a linear actuator coupled to the seat frame at a front end of the seat frame, the linear actuator terminating in a top connection member that engages the lower surface of the seat at a front end of the seat, the linear actuator moving the front end of the seat between the first and second positions.

6. The riser seat of claim 5 further comprising a pivot that connects the top connection member to the seat, the seat pivoting about the pivot.

7. The riser seat of claim 6 wherein the cam arm and the linear actuator are independently movable.

8. The riser seat of claim 1 wherein the cam arm is a first cam arm and the riser seat further comprises a second cam arm pivotably mounted with respect to the seat frame, the second cam arm having a camming surface movably engaged with the seat and configured to move the seat between the first and second positions, wherein the camming surface moves tangentially relative to the lower surface of the seat when the seat is moved between the first and second positions.

9. The riser seat of claim 8 wherein the first cam arm and the second cam arm are coupled to the seat frame at a pivot point, and the first cam arm and the second cam arm pivot about the pivot point.

10. The riser seat of claim 8 wherein the first cam arm is coupled to the seat frame at a first pivot point and the first cam arm pivots about the first pivot point, and the second cam arm is coupled to the seat frame at a second pivot point and the second cam arm pivots about the second pivot point.

11. The riser seat of claim 1 further comprising a connection member on the cam arm, wherein the connection member engages the seat to maintain engagement between the camming surface and the lower surface of the seat.

12. The riser seat of claim 11 wherein the seat further comprises a guide track, the connection member of the cam arm engages the guide track of the seat.

13. The riser seat of claim 1 further comprising an aperture through the seat such that the seat functions as a commode.

14. The riser seat of claim 1 wherein the lower surface of the seat further comprises a track disposed along the lower surface, the camming surface contacting the track, the track facilitating the tangential movement of the camming surface relative to the lower seat.

15. The riser seat of claim 14 wherein the track comprises a friction reducing material.

16. The riser seat of claim 14 wherein the track comprises at least one roller.

17. The riser seat of claim 1 wherein the camming surface comprises a roller or bearing that engages the lower surface of the seat.

18. The riser seat of claim 1 wherein the cam arm further comprises a plurality of rotatably coupled cam sections.

19. The riser seat of claim 18 wherein the cam arm further comprises a center shaft and the plurality of rotatably coupled cam sections are mounted to the center shaft such that the cam sections rotate about the center shaft.

20. The riser seat of claim 18 wherein each of the plurality of cam sections further comprises a peg and a slot that receives a peg of an adjacent cam section, wherein the interaction of the peg and the slot restricts rotational movement of the plurality of cam sections.

21. A riser seat for assisting a person from a sitting position to a standing position, comprising:

a seat frame;

a seat comprising upper and lower surfaces, the seat being movable between first and second positions;

first and second cam arms pivotably mounted with respect to the seat frame, each of the first and second cam arms having a camming surface movably engaged with the seat wherein the camming surface moves tangentially relative to the lower surface of the seat when the seat is moved between the first and second positions; and first and second linear actuators coupled to the seat frame, wherein each of the first and the second linear actuators engage the seat at a front end of the seat;

wherein coordinated movement of the first and the second cam arms and the first and the second linear actuators moves the seat between the first and second positions.

22. The riser seat of claim 21 wherein the first cam arm, the second cam arm, the first linear actuator, and the second linear actuator are each independently movable.

23. The riser seat of claim 22 further comprising a first pivot that connects the first linear actuator to the seat and a second pivot that connects the second linear actuator to the seat, the seat being pivotably moveable about the first pivot and the second pivot.

24. The riser seat of claim 23 wherein the coordinated movement of the first and second cam arms and the first and second linear actuators moves the seat along a movement profile wherein the movement profile lifts and tilts the seat.

25. The riser seat of claim 24 wherein the movement profile further pitches the seat to a first side of the seat.

26. The riser seat of claim 23 wherein the first cam arm is coupled to the seat frame at a first pivot point and the first cam arm moves about the first pivot point, and the second cam arm is coupled to the seat frame at a second pivot point and the second cam arm moves about the second pivot point.

27. A method using the riser seat of claim 21 to move a person sitting on the seat from a seated position to a standing position, comprising:

simultaneously moving the first and second linear actuators and the first and second cam arms to lift the person in a seated position;

maintaining a position of the first and second linear actuators; and moving the first and second cam arms to tilt the person into a standing position.

28. The method of claim 27 further comprising:

simultaneously moving the first linear actuator and the first cam arm such that a first side of the seat is raised above a second side of the seat such as to pitch the seat in the direction of the second linear actuator and the second cam arm.

29. A riser seat for assisting a person from a sitting position to a standing position, comprising:

a seat frame;

a seat comprising upper and lower surfaces, the seat being movable between first and second positions; and first, second, third, and fourth cam arms pivotably mounted with respect to the seat frame, each of the first, second, third, and fourth cam arms having a camming surface movably engaged with the seat wherein each of the camming surfaces move tangentially relative to the lower surface of the seat when the seat is moved between the first and second positions;

wherein coordinated movement of the first, second, third, and fourth cam arms moves the seat between the first and second positions.

30. The riser seat of claim 23, wherein the first, second, third, and fourth cam arms are each independently movable.

31. The riser seat of claim 29, further comprising a first pivot point that couples the first cam arm to the seat frame, a second pivot point that couples the second cam arm to the seat frame, a third pivot point that couples the third cam arm to the seat frame, and a fourth pivot point that couples the fourth cam arm to the seat frame.

32. The riser seat of claim 29 wherein the coordinated movement of the first, second, third, and fourth cam arms move the seat along a movement profile that lifts and tilts the seat.

33. The riser seat of claim 32 wherein the movement profile further pitches the seat to a first side of the seat.

34. A method of using the riser seat of claim 29 to move a person sitting on the seat from a seated position to a standing position, comprising:

simultaneously moving the first, second, third, and fourth cam arms to lift the person in a seated position;

maintaining a relative position of the first cam arm;

simultaneously moving the second, third, and fourth cam arms to lift the person;

maintaining a relative position of the second cam arm;

simultaneously moving the third and fourth cam arms to lift the person;

maintaining a relative position of the third cam arm; and moving the fourth cam arm to tilt the person into a standing position.

35. The method of claim 34, further comprising:

simultaneously moving the first, second, and third cam arms such that a first side of the seat is raised above a second side of the seat such as to pitch the seat in the direction of the fourth cam arm.

36. An adjustable position riser seat comprising:

a seat frame;

a seat comprising upper and lower surfaces, the seat being movable between first and second positions; and a cam arm pivotably mounted with respect to the seat frame and having a camming surface movably engaged with the seat and configured to move the seat along a movement profile between the first and second positions, wherein the camming surface defines the movement profile and the camming surface moves tangentially relative to the lower surface of the seat to move the seat between the first and second positions.

37. An adjustable position riser seat comprising:

a seat frame;

a seat comprising upper and lower surfaces, the seat being movable between first and second positions;

a first cam arm pivotably mounted with respect to the seat frame and the first cam arm having a camming surface movably engaged with the seat and configured to move the seat between the first and second positions; and a second cam arm pivotably mounted with respect to the seat frame and the second cam arm having a camming surface movably engaged with the seat and configured to move the seat between the first and second positions;

wherein the camming surfaces move tangentially relative to the lower surface of the seat when the seat is moved between the first and second positions.

38. The riser seat of claim 37 wherein the first cam arm and the second cam arm are coupled to the seat frame at a pivot point, and the first cam arm and the second cam arm pivot about the pivot point.

39. The riser seat of claim 37 wherein the first cam arm is coupled to the seat frame at a first pivot point and the first cam arm pivots about the first pivot point, and the second cam arm is coupled to the seat frame at a second pivot point and the second cam arm pivots about the second pivot point.

* * * * *